US007926306B2

(12) United States Patent
Koenig et al.

(10) Patent No.: US 7,926,306 B2
(45) Date of Patent: Apr. 19, 2011

(54) MACHINE FOR PRODUCING A KNITTED FABRIC FROM FIBRE MATERIAL, IN PARTICULAR CIRCULAR KNITTING MACHINE

(75) Inventors: Reinhard Koenig, Ettlingen (DE); Georg Koenig, Waldbronn (DE)

(73) Assignee: Reinhard Koenig, Ettlingen (DE)

( * ) Notice: Subject to any disclaimer, the term of this patent is extended or adjusted under 35 U.S.C. 154(b) by 213 days.

(21) Appl. No.: 12/278,178

(22) PCT Filed: Feb. 13, 2007

(86) PCT No.: PCT/DE2007/000286

§ 371 (c)(1),
(2), (4) Date: Aug. 4, 2008

(87) PCT Pub. No.: WO2007/093165

PCT Pub. Date: Aug. 23, 2007

(65) Prior Publication Data

US 2009/0064719 A1 Mar. 12, 2009

(30) Foreign Application Priority Data

Feb. 13, 2006 (DE) ..... 10 2006 006 502

(51) Int. Cl.
*D04B 9/14* (2006.01)

(52) U.S. Cl. ..... 66/9 B

(58) Field of Classification Search ..... 66/9 R, 66/9 B, 168, 8
See application file for complete search history.

(56) References Cited

U.S. PATENT DOCUMENTS

| | | | | | |
|---|---|---|---|---|---|
| 3,226,952 | A | * | 1/1966 | Cassady | 66/9 B |
| 3,299,672 | A | * | 1/1967 | Schmidt | 66/9 R |
| 3,732,135 | A | * | 5/1973 | Ernst et al. | 66/9 B |
| 3,918,274 | A | | 11/1975 | York et al. | |
| 4,006,609 | A | * | 2/1977 | Abler | 66/9 B |
| 4,245,487 | A | * | 1/1981 | Schaab et al. | 66/9 B |
| 4,563,884 | A | * | 1/1986 | Kunde et al. | 66/9 B |
| 5,134,863 | A | * | 8/1992 | Hanna | 66/9 B |
| 5,431,029 | A | * | 7/1995 | Kuhrau et al. | 66/9 B |
| 5,809,804 | A | * | 9/1998 | Kuhrau et al. | 66/9 B |
| 6,151,920 | A | * | 11/2000 | Schindler et al. | 66/9 R |
| 6,247,335 | B1 | * | 6/2001 | Schaeberle et al. | 66/9 B |

FOREIGN PATENT DOCUMENTS

| | | |
|---|---|---|
| DE | 24 51 900 | 5/1975 |
| DE | 10 2006 006 504 | 8/2007 |
| WO | 2004/079068 | 9/2004 |

* cited by examiner

*Primary Examiner* — Danny Worrell
(74) *Attorney, Agent, or Firm* — Michael J. Striker

(57) ABSTRACT

A machine is described for producing a knitted fabric with at least partial use of fibrous material (10), in particular a circular knitting machine (1). At least selected knitting stations (6) are assigned drawing frames (8) for producing threads (11) which are formed from the fibrous materials (10). According to the invention, the drawing frames (8) lie in the reaching area of an operator (5) working on the machine (1) and can be opened downwards (arrow v) or to the side.

27 Claims, 15 Drawing Sheets

MACHINE FOR PRODUCING A KNITTED FABRIC FROM FIBRE MATERIAL, IN PARTICULAR CIRCULAR KNITTING MACHINE

BACKGROUND OF THE INVENTION

The invention relates to a machine for producing a knitted fabric from fibre material, in particular a circular knitting machine.

Machines of this type are distinguished by the predominant or exclusive use of threads that consist of largely untwisted staple fibres arranged parallel to one another instead of classic yarns. Such threads are produced in drafting devices connected directly in front of the stitch-forming points of the machine from slivers or bands fed to them, and to ensure a disturbance-free transport from the drafting devices to the stitch-forming points, are converted by means of spinning elements into temporary yarns, the twists of which are only removed again shortly before running into the stitch-forming points (false twist effect). Therefore, the threads actually processed into knitted fabric substantially consist of untwisted parallel threads, which is why the finished knitted fabric is distinguished by an extreme softness. While additional auxiliary threads consisting of classic yarns can be worked in, if required, this is not fundamentally necessary.

A known machine of the aforementioned type configured as a circular knitting machine (PCT WO 2004/079068 A2) has one drafting device for each stitch-forming point. Since the drafting devices cannot be configured as small as desired, a substantial space and handling problem results. Therefore, it has been provided, for example, to arrange the drafting devices at comparatively substantial distances from the circular knitting machine and to surround this with a raised work platform, from which the drafting devices are accessible. While it is possible as a result of this to arrange a large number of drafting devices on the periphery of the circular knitting machine, this poses the disadvantage that when a fault occurs in one of the drafting devices, the operator working on the circular knitting machine must leave his/her usual work area in front of the machine, get on the work platform, eliminate the fault from there and than return to his/her usual work area. This is not only inconvenient, but also requires special cost-incurring protective measures in the form of railings or the like that delimit the work platform in order to prevent the operator from accidentally falling from the work platform. Moreover, additional measures that further increase the production costs must be taken, which consist, for example, of a multiplicity of spinning elements and transport tubes following these for each stitch-forming point in order to securely transport the threads leaving the drafting devices as far as the knitting needles or other stitch-forming elements. If in order to avoid these disadvantages the drafting devices were arranged directly on the machine, in particular on the periphery of a circular knitting machine, then the space between the drafting devices would become ever smaller as the number of knitting points or systems increases, so that with the usual arrangement the drafting devices would no longer be accessible and economic maintenance operations and/or repairs of the drafting devices would thus be practically impossible.

In addition, it is also already known to combine the drafting devices in a bar shape to form three groups, which are arranged at angular distances of approximately 120° on the periphery of the circular knitting machine. However, this solution poses the additional advantage that the routes of the drafting devices to the stitch-forming points fluctuate greatly. This results in different friction conditions for the threads, in particular if transport tubes are also used in this case, which can result in different thread tensions and cause the threads exposed to an increased friction to break more easily. Apart from this, all solutions, in which two or more spinning elements operated mechanically or by compressed air are necessary for each stitch-forming point, have the disadvantage of increased energy consumption.

SUMMARY OF THE INVENTION

Working from this, the technical problem of the invention is to configure the machine of the aforementioned type such that even with high system numbers, the drafting devices can be arranged closely adjacent to the machine and still be easily operated, maintained and repaired, where necessary.

The invention provides the advantage that compared to the hitherto exclusive method, the drafting devices can be operated from below and/or from the side. For this purpose, press arms known per se, on which the so-called top rollers are mounted, can be arranged, for example, so that they can be pivoted downwards or to the side instead of upwards. Another preferred possibility is to mount at least selected function parts, in particular drafting device elements such as rollers or aprons, on a structural element that can be pulled out of the associated drafting device downwards or to the side in the manner of an insertion part. This enables the drafting devices to be moved closely adjacent to the stitch-forming or knitting points, wherein they are preferably arranged above the stitch-forming points, while still remaining within the reach of the operator working on the machine. The operator can therefore perform all the necessary work on the drafting devices by folding or pulling out the function parts downwards or to the side without having to leave his/her usual work area.

BRIEF DESCRIPTION OF THE DRAWINGS

The invention is explained in more detail below by way of exemplary embodiments in association with the attached drawings.

DETAILED DESCRIPTION OF THE PREFERRED EMBODIMENTS

The invention is explained in more detail below on the basis of a stitch-forming machine, which in the exemplary embodiments is a circular knitting machine that has a plurality of stitch-forming points in the form of knitting points or systems and stitch-forming elements in the form of usual latch needles. However, it is evident that the invention can also be conducted in the same manner or an appropriately adapted manner on other stitch-forming machines.

Figure 1:
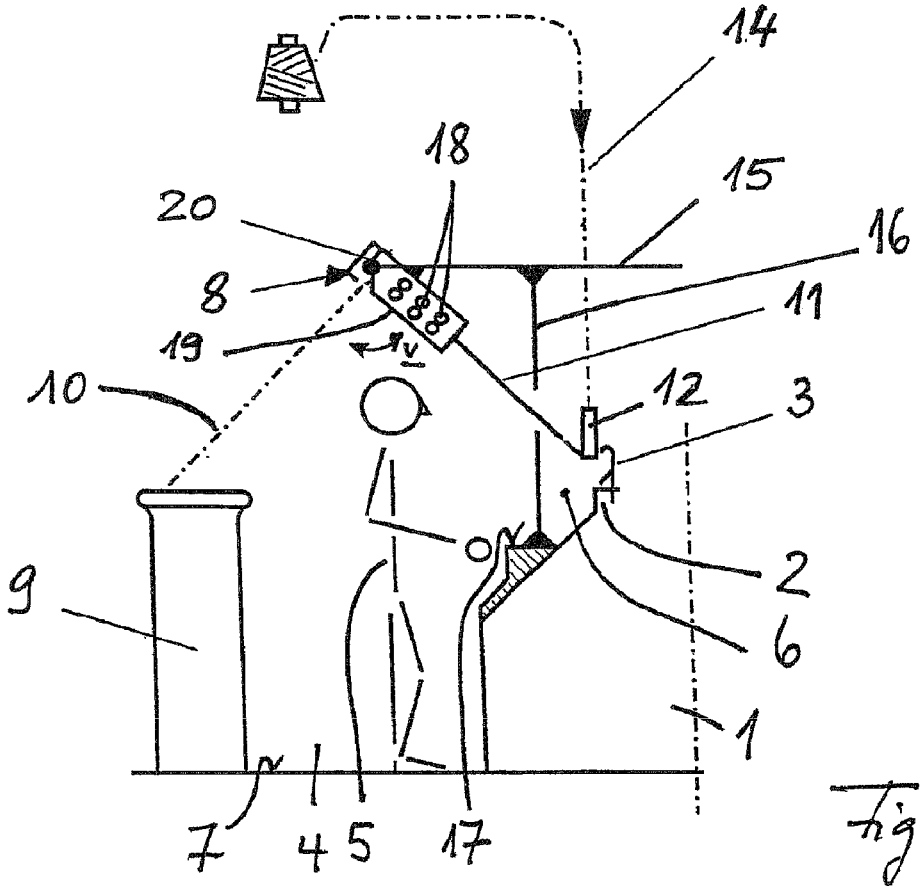
FIG. 1 shows a schematic vertical section through a first exemplary embodiment of a circular knitting machine according to the invention.
Figure 2:
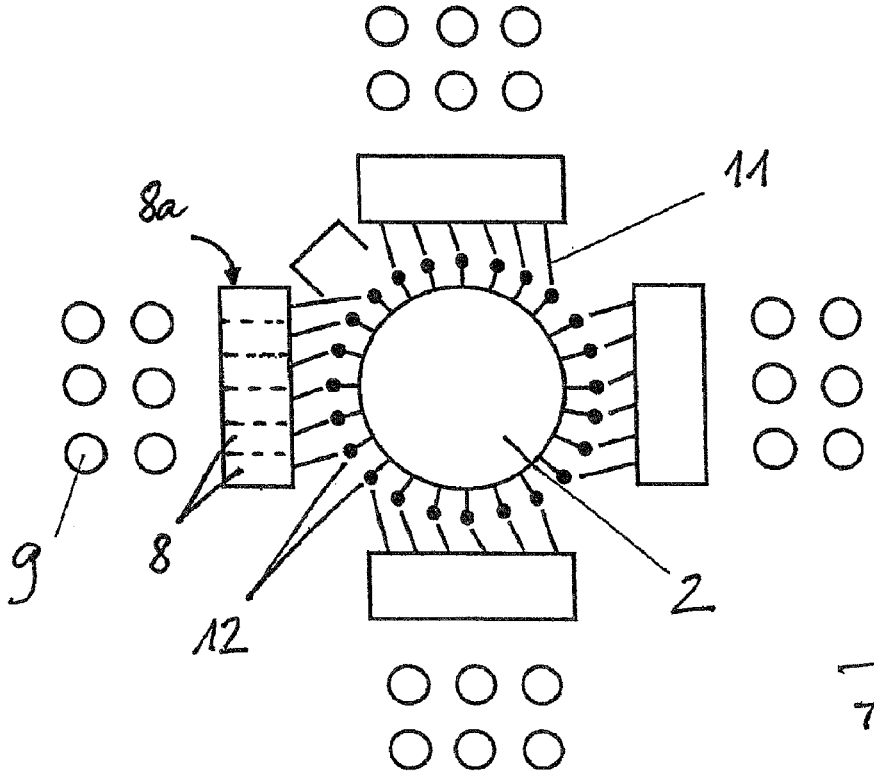
FIG. 2 is a plan view onto the circular knitting machine according to FIG. 1 with the omission of an auxiliary thread.

FIGS. 1 and 2 schematically show a circular knitting machine 1 with a rotatable needle cylinder 2, in which knitting needles 3 are displaceably disposed. A work area 4, which an operator 5 occupies during usual work on the circular knitting machine 1, is indicated schematically in front of the circular knitting machine 1 or in a region surrounding this. The height of the circular knitting machine 1 is usually dimensioned such that a plurality of stitch-forming or knitting points 6, which are formed in cam parts (not shown) and of which only one is shown in FIG. 1, lie within the reach of the operator 5. The term "reach" is understood to mean the region that is preferably arranged at a particularly ergonomically favourable distance and/or a distance prescribed, for example, by work instructions, standards or similar above the ground 7 or the like, on which both the circular knitting machine 1 and the operator 5 stand.

The circular knitting machine 1 of interest within the framework of the present invention is configured as a so-called spinning-knitting machine. Each stitch-forming or knitting system 6 has an associated drafting device 8, to which a sliver 10 removed from a can 9 is fed. This sliver 10 is attenuated to a thread 11 in the drafting device 8 in a manner known per se and is preferably fed by means of a thread guide 12 to the knitting needles 3 for stitch formation. In addition, an auxiliary thread that can also be fed to the thread guide 12 is indicated at reference 14.

As FIG. 2 shows, in the exemplary embodiment six drafting devices 8 are respectively combined to form a drafting device group 8*a*, which feed the threads 11 for six adjacent knitting points, characterised here by the thread guide 12. For this purpose, six drafting devices 8 with coaxially located rollers are respectively arranged adjacent to one another, for example, so that the bar-shaped arrangement evident from FIG. 2 with four drafting device groups 8*a* results, for example, which are arranged on the periphery of the needle cylinder 2 and feed threads 11 for a total of 24 knitting points.

Stitch-forming machines of the described type are known to the person skilled in the art e.g. from the aforementioned publication PCT WO 2004/079068 A2, which is herewith incorporated into the subject of the present disclosure by reference to avoid repetition.

According to the invention, the drafting devices 8 are arranged so that, like the stitch-forming points 6, they lie within the reach of the operator 5 working on the circular knitting machine 1. For this purpose, the drafting devices 8 are fastened to a support ring 15, for example, which is supported on a base or cam plate 17 of the circular knitting machine 1 by means of columns 16. In a particularly advantageous manner, moreover, the arrangement is such that the nip lines formed by three or more pairs of function parts (e.g. drafting rollers 18 or the like) do not lie in horizontal planes, but lie in inclined planes in accordance with FIG. 1, wherein feed roller pairs facing the respective cans 9 lie higher above the ground 7 than withdrawal roller pairs facing the circular knitting machine 1.

The exemplary embodiment according to FIGS. 1 and 2 is distinguished by the axes of the drafting devices 18 all being arranged horizontally in the state of use. In order to ensure that the drafting devices 8 are not only reachable for the operator 5 from the work area 4, but can also be easily maintained and/or repaired without having to be fully dismantled, the drafting devices 8 can be at least partially opened by their essential function parts being disposed, according to the invention, to be able to pivot at least partially downwards into the drafting devices 8. This is indicated in FIG. 1 by a structural element in the form of a press arm 19 supporting the so-called top rollers, which, in contrast to the conventional technique, lies at the bottom instead of at the top and can be pivoted in the direction of an arrow v around a horizontal pivot axis 20 indicated by way of example. As a result of this, the top rollers of a selected drafting device 8 can be exposed, if necessary, so that aprons present on these can replaced, fibre clumps present in the drafting device 8 can be removed and other work can be conducted without the operator 5 having to leave his/her work area 4.

Figure 3:
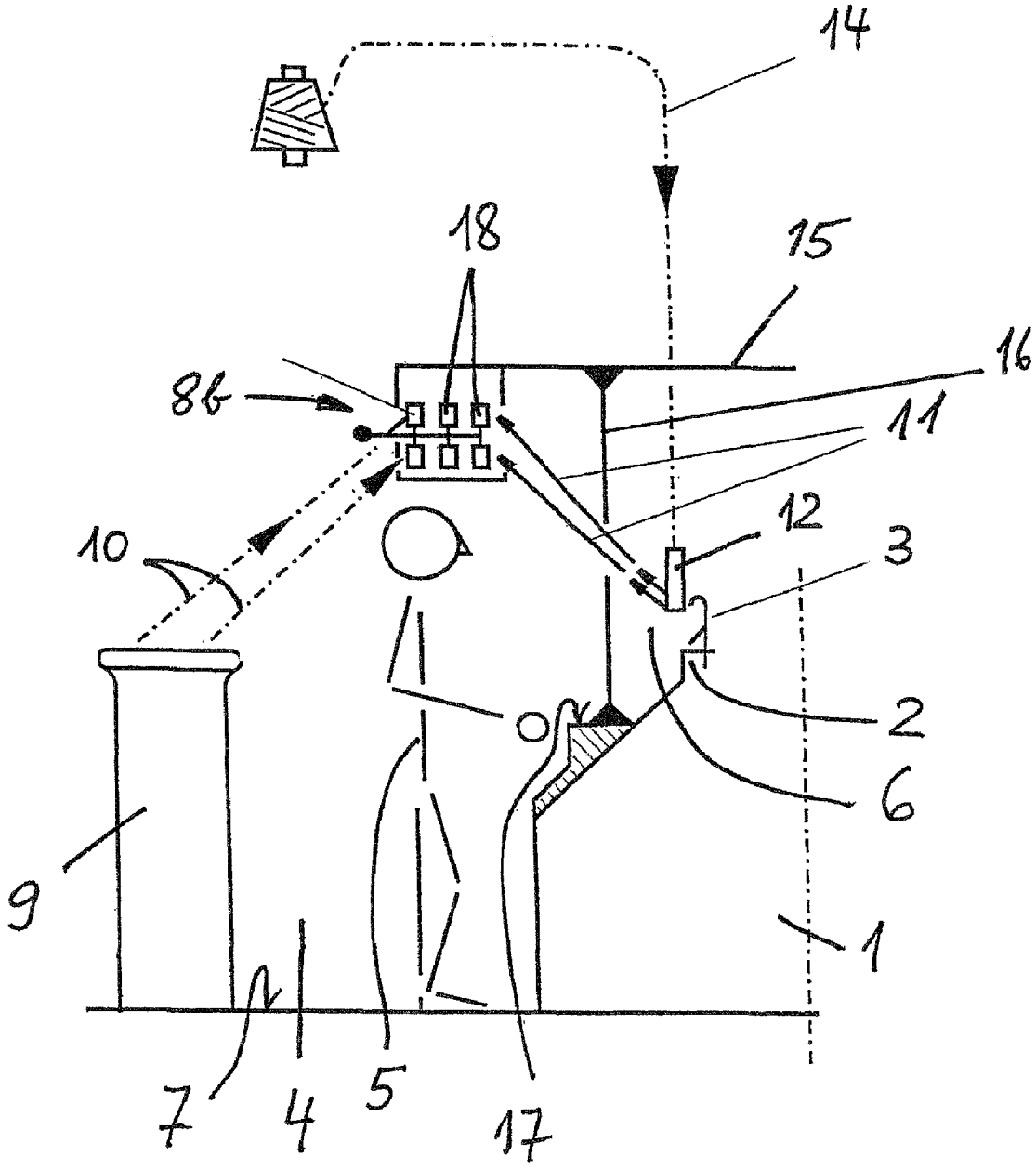
FIG. 3 shows a schematic vertical section through a second exemplary embodiment of a circular knitting machine according to the invention.
Figure 4:
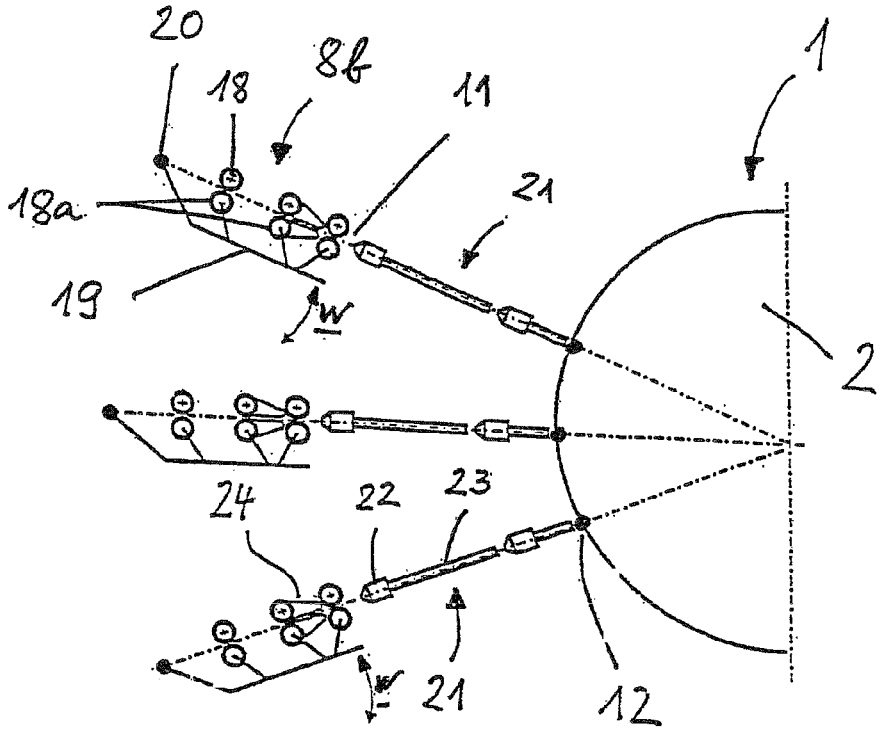
FIG. 4 is a plan view onto the circular knitting machine according to FIG. 3 with the omission of an auxiliary thread and with the addition of spinning devices.

The exemplary embodiment according to FIGS. 3 and 4 differs from the exemplary embodiment according to FIGS. 1 and 2 primarily in that the drafting devices 8 here are mounted on the circular knitting machine 1 in a position rotated 90° relative to FIG. 1 and in the position of use are arranged vertically instead of horizontally. Therefore, the same parts are provided with the same reference numerals in FIGS. 3 and 4 as in FIGS. 1 and 2. Pairs of associated drafting devices 8 come to lie adjacent to one another in accordance with FIG. 4. FIG. 4 additionally shows that here the press arms 19, which support the so-called top rollers (18*a*), can be pivoted around pivot axes 20, which are likewise arranged rotated 90° compared to FIG. 1 and stand vertically. Therefore, the press arms 19 cannot be pivoted downwards, but to the side in the direction of arrows w (FIG. 4). This can be seen more precisely in FIGS. 4*a* and 4*b*, which show a usual press arm 19 and its elements 19*a*, 19*b* provided for operation and locking in the closed state (FIG. 4*a*) and in the open state (FIG. 4*b*).

So that the press arms 19 have a sufficiently large pivoting area and do not immediately strike against an adjacent drafting device when a drafting device 8 is opened, according to the exemplary embodiment of FIGS. 3 and 4 it can be provided, as is only indicated in FIG. 4, that the threads 11 leaving the drafting devices 8 are fed to the associated knitting points by means of spinning devices 21. As is known from the aforementioned publication, these spinning devices 21 include, for example, at least one respective twist element 22 and a spinning tube or transport tube 23 connected to this. The purpose of the spinning devices 21 is to firstly convert threads 11 discharging from the drafting devices 8 into temporary yarns with genuine twists, which are released again between the ends of the spinning tubes 23 and the thread guides 12 associated with the knitting points 6 (FIG. 3) because of the so-called false twist effect. Because of the selectable length of the transport tube 23 arranged radially to the circular knitting machine 1, the distance of the drafting devices 8 from the centre axis of the needle cylinder 2 can be selected to be comparatively large and substantially as desired. As a result, the resulting distance in the peripheral direction between two adjacent drafting devices 8 can also be fixed at a preselected value allowing the press arms 19 to pivot. Corresponding spinning devices 21 can be provided in the exemplary embodiment according to FIGS. 1 and 2.

In addition, the exemplary embodiment according to FIGS. 3 and 4 has the advantage over that according to FIGS. 1 and 2 that because they stand vertically, the drafting rollers 18 can be driven in a simple manner by drive belts disposed in a circle, which are arranged above the drafting devices and extend in the peripheral direction of the needle cylinder 2. For this, the shafts of each so-called bottom roller of the three roller pairs shown are provided on their upper side with a respective toothed pulley, for example. A corresponding drive could be provided for the bottom rollers of the exemplary embodiment according to FIGS. 1 and 2. However, the drive torques transferred by means of the toothed belt here would have to be converted by means of bevel gears or the like into torques for the bottom rollers standing horizontally here.

Finally, it is particularly advantageous according to the exemplary embodiment of FIGS. 3 and 4, as FIG. 3 shows in particular, that two or also more drafting devices can be arranged here with their rollers 18 coaxially one above the other. As a result of this, it is possible to halve the space required for the drafting devices 8 in the peripheral direction or reduce this still further, since in this case two or more threads can be guided to the adjacent knitting points from each drafting device segment, as is indicated in FIG. 3 by two threads 11. As a result of this, the package density of the drafting means can be doubled or tripled.

Figure 5:
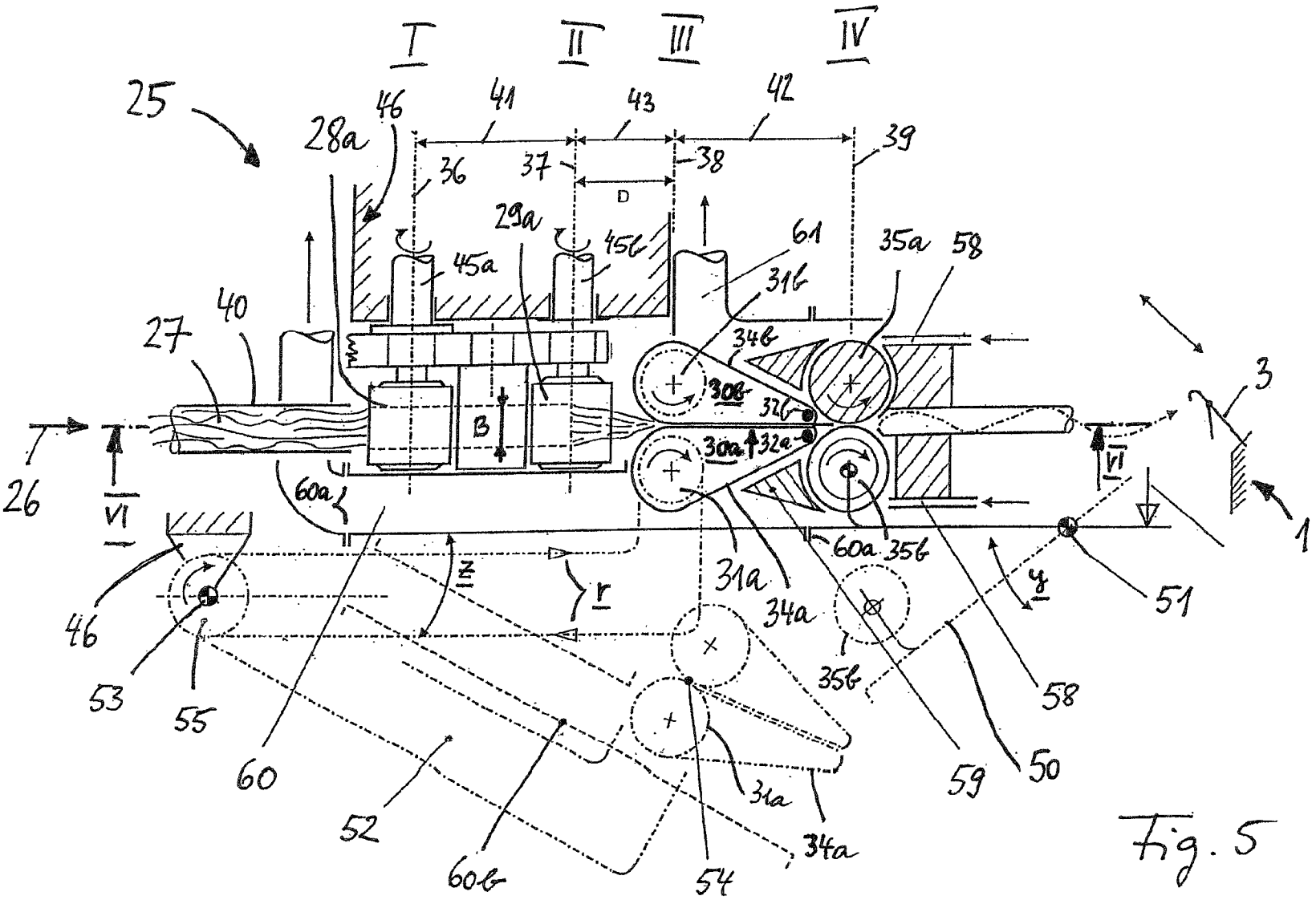
FIG. 5 shows a longitudinal section through a drafting device for the circular knitting machine of FIG. 1 according to a first exemplary embodiment.
Figure 6:
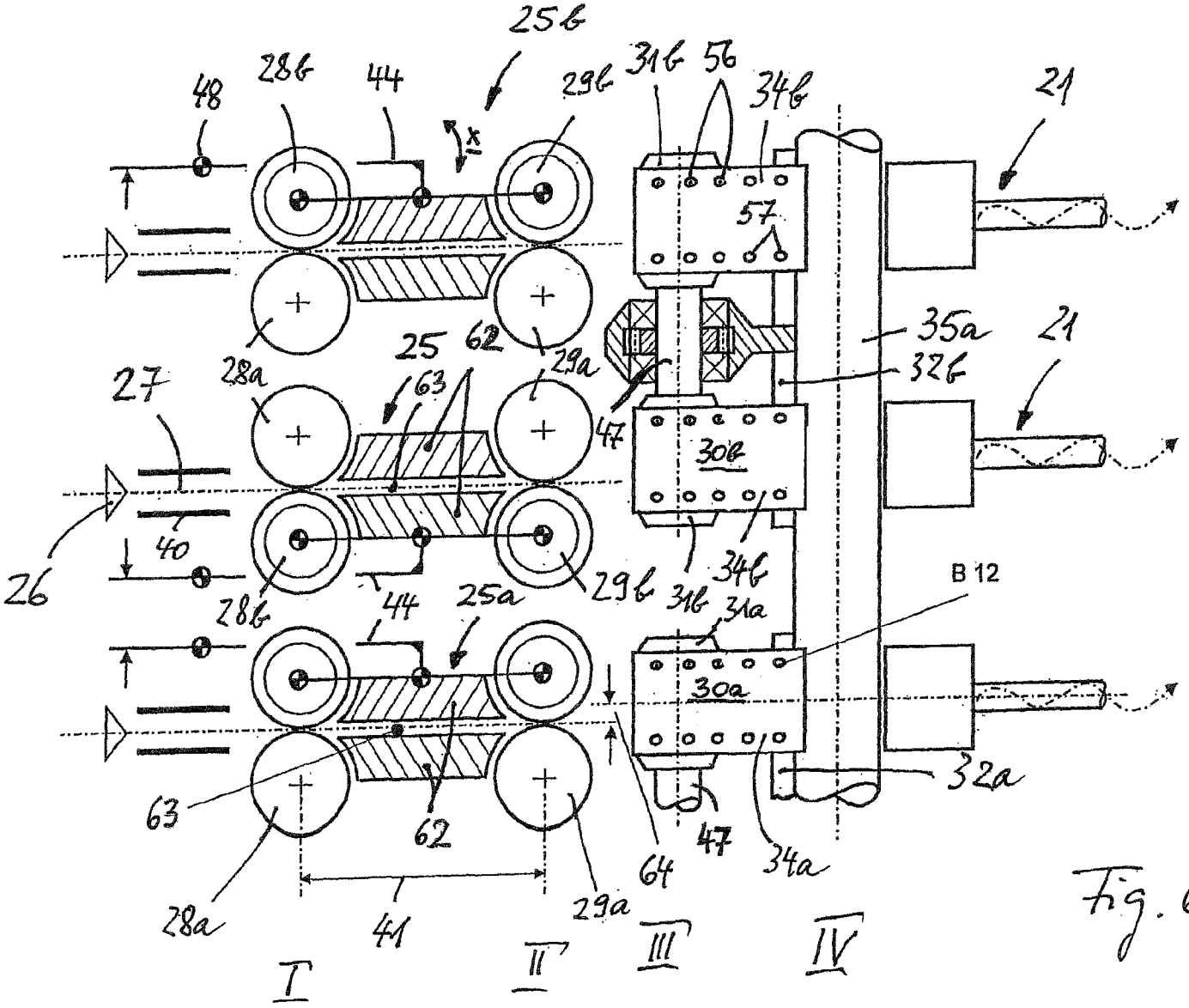
FIG. 6 shows a section taken approximately along a line VI-VI in FIG. 5.

The invention has been described thus far on the basis of drafting devices 8, which are distinguished by the feature that the rotational axes of all the drafting device elements, which can also include function parts in the form of aprons 24 (FIG. 4), are arranged parallel to one another. In particular, during operation the rotational axes of the exemplary embodiment according to FIGS. 1 and 2 are arranged horizontally and the rotational axes of the exemplary embodiment according to FIGS. 3 and 4 are arranged vertically. However, apart from this the invention should also be applicable to drafting devices having rotational axes that are arranged at preselected angles between 0° and 90° relative to one another. This applies in particular to so-called folding drafting devices, which fold the fibre materials during their transport through the drafting device elements around an axis parallel to the transport direction and thus reduce the width of the fibre materials by half or more. Such drafting devices are explained in more detail below on the basis of FIGS. 5 and 6, wherein FIG. 5 is a schematic side view in partial section of a single drafting device 25 and shows its drafting device elements or function parts and also further details, whereas FIG. 6 is a sectional view through the drafting device 25 taken approximately along line VI-VI of FIG. 5. It is evident therefrom that the drafting device 25 can be combined together with two adjacent drafting devices 25*a* and 25*b* according to FIG. 6 and also possibly drafting devices (not shown) similar to FIGS. 1 and 2 to form a group or a bar.

According to FIGS. 5 and 6, a fibre material 27 is directed through the drafting device 25 in a transport direction 26 indicated by arrows. For this, the drafting device 25 has four pairs I, II, III and IV of drafting device elements lying one behind the other in the transport direction 26. The first pair I in transport direction 26 and the following second pair II include two rollers 28*a*, 28*b* and 29*a* and 29*b* respectively as drafting device elements, only one respective roller 28*a*, 29*a* of which is visible in FIG. 5. The following third pair III includes drafting rollers 31*a* and 31*b* respectively as drafting device elements 30*a* and 30*b*, only one of which is visible in FIG. 6, deflection elements 32*a* and 32*b* associated with these, which can consist of deflection rollers or bars, and aprons 34*a* and 34*b*, which are directed over the deflection elements 32*a*, 32*b* and the associated rollers 31*a*, 31*b* and in the manner known for double-apron drafting devices comprise a lower apron 34 and an upper apron 34*b*, between which the fibre material 27 is guided after leaving the drafting rollers 31*a*, 31*b*. Finally, the fourth pair IV, the last in transport direction, in turn includes two drafting device elements in the form of a respective roller 35*a* and 35*b*. The rotational axes of the rollers 31 and 35 as well as the axes of the deflection elements 32 are arranged perpendicularly to the rotational axes of the rollers 28 and 29. Apart from this, all four pairs I to IV define the usual nip lines 36, 37, 38 and 39, indicated by dot-dash lines in FIG. 5, between the said rollers 28, 29, 31 and 35. At the inlet to the drafting device 25 a feed funnel or trocar 40 is provided, through which the fibre material 27 is fed and slightly compacted.

According to FIG. 5, pairs I and II of the drafting device elements 28, 29 form a pre-drafting zone 41, wherein the circumferential speeds of the drafting device elements 28, 29 are selected, for example, so that a drafting of between 5- and 15-fold of the fibre material 27 is achieved, which comes close to the drafting of a usual flyer frame. In contrast, the fibre material 27 between the nip lines 28 and 39 or in a zone 42 is subjected to a main drafting operation, which leads to a draft of the fibre material 27 of about 50-times or more, for example, and to a preselected final fineness.

Finally, the described drafting device 25 has at least two pairs of drafting device elements, which cause folding of the fibre material 27. These are pairs II and III in FIG. 5, the nip lines 37 and 38 of which form a folding zone 43 between them. In contrast to the drafting zones 41 and 42, only a tensioning draft occurs between the nip lines 37 and 38 that preferably amounts to 10%, for example, and is just sufficient to hold the fibre material 27 under tension and effect a defined folding.

For folding the fibre material 27 in the folding zone 43, centre axes (not further shown) of the rollers 29*a*, 29*b* and the nip line 37 are arranged perpendicularly to the transport direction 26 and vertically, for example, during operation, while the centre axes of the rollers 31*a*, 31*b* intended to drive the aprons 34*a*, 34*b* and the nip line 38 also extend transversely to the transport direction 26, but extend horizontally during operation. In other words, the centre axes of the rollers 31 of pair III are arranged tilted or pivoted 90° relative to the centre axes of the rollers 29 of pair II. In contrast, the centre axes of the drafting device elements 28 are arranged parallel to those of the drafting device elements 29 and the centre axes of the drafting device elements 35 are arranged parallel to those of the rollers 31.

A consequence of the arrangement of the rotational axes of the rollers 29 and 31 pivoted 90° is that, while keeping to preselected conditions, the band-shaped fibre material 27 between the nip lines 37 and 38 is folded in a defined manner around at least one folding line, which extends parallel to the transport direction 26 and therefore causes a reduction in the width of the fibre material 27. Similar would naturally also apply if the drafting device elements 30*a*, 30*b* only had the rollers 31*a*, 31*b*, i.e. the aprons 34*a*, 34*b* unfold fully, or if both pairs II and III are provided with drafting device elements formed from rollers and aprons. There is no change to the type of folding as a result of this.

The type of folding that results is substantially dependent both on the selection of a distance D (FIG. 5) between the nip lines 37 and 38 of the drafting device elements 29, 30 preferably pivoted 90° or of the length D of the folding zone 43, as well as the selection of a width B (FIG. 5) of the fibre material 27 leaving the rollers 29*a*, 29*b*. With a decreasing distance D and an increasing width B, the folding changes from V-shaped via N-shaped and W-shaped to W-shaped with extensions, i.e. the shape of the fold is a function of the distance D and the width B. In a particularly advantageous manner, the distance D and the width B are set so that a W-shaped fold results and the original width B of the fibre material is reduced from 20 mm, for example, to an end width of approximately 5 mm. This width corresponds approximately to the diameter of a usual roving yarn with the result that fibre material reduced to this width can be spun and/or fed to the stitch-forming machines according to FIGS. 1 to 4 in the usual manner without any further intermediate step. Such a folding is achieved if the distance D is about double the size of the width B. The desired conditions in the individual case can be easily determined by tests.

Further details relating to the described folding are explained in a parallel application DE 10 2006 006 504.2 (application date 13.02.06) of the same applicant, and this is incorporated herewith into the subject of the present disclosure by reference to avoid repetition.

For the purposes of the present invention it is above all significant with respect to FIGS. 5 and 6 that the axes of the feed rollers 28*a*, 28*b* stand perpendicular to the axes of the withdrawal rollers 35*a*, 35*b*. Therefore, it is unimportant, in principle, whether the distance D and the width B of the fibre material 27 in FIGS. 5 and 6 are selected so that the described folding results, or whether the arrangement of the axes perpendicularly to one another serves other purposes, as will be explained in more detail below.

FIG. 6 shows that the drafting devices 25*a* and 25*b* are configured substantially the same as the drafting device 25 and the overall arrangement analogous to FIGS. 1 and 2 is suitable in particular for bar-shaped grouping. For example, the three drafting devices 25, 25*a* and 25*b* lie adjacent to one another in FIG. 6. However, it is clear that groups of only two or even with more than three adjacent drafting devices could also be provided. Moreover, FIG. 6 shows that the drafting devices 25, 25*a* and 25*b* preferably differ from one another through the relative positions of their rollers 28, 29. Viewed in the transport direction 27—the drafting devices 25*a* and 25*b* respectively have top rollers 28*b*, 29*b* located on the left, represented by double circles, and bottom rollers 28*a*, 29*a* located on the right, whereas in the central drafting device 25 the situation is reversed with the bottom rollers 28*a*, 29*a* lying on the left and the top rollers 28*b*, 29*b* on the right. Because of this and because the rollers 28, 29 stand vertically, for example, during operation, while the rollers 31, 35 are arranged horizontally, the terms "bottom roller" and "top roller" are misleading, since they no longer indicate the "bottom" or "top" position, as is exclusively usual in spinning technology. Therefore, for the purposes of the present application the bottom rollers 28*a*, 29*a*, 31*a* and 35*a* are generally referred to as the driving rollers and the top rollers 28*b*, 29*b*, 31*b* and 35*b* as the driven rollers. This additionally indicates that the rollers 28*b*, 29*b*, 31*b* and 35*b* do not generally have their own drive, but are pressed in a known manner by structural elements in the form of usual press arms 44 (FIG. 6) or 19 (FIGS. 1 and 4) and an elastic or pneumatic force, for example, against associated driving rollers 28*a*, 29*a*, 31*a* and 35*a* and are set in rotation by these as a result of frictional force. However, the driving rollers 28*a*, 29*a*, 31*a* and 35*a* have a respective forced drive. This is indicated in FIG. 5, for example. The driving rollers 28*a*, 29*a* are rotatably disposed here with shafts 45*a*, 45*b* in a bearing block or housing 46, and the shafts 45*a*, 45*b* are provided, for example, with toothed pulleys, gear wheels or the like, which are in engagement with toothed belts, further gear wheels or the like and can be set in rotation by means of these by drive motors (not shown). The rollers 31*a* and 35*a* can be driven in a similar manner. As FIG. 6 shows, it is also possible, analogously to the exemplary embodiment according to FIGS. 3 and 4, to configure the driven rollers 31*b* of two adjacent drafting devices (e.g. 25, 25*b*) in pairs on a common shaft 47 and/or arrange the driving rollers on a common shaft, which extends axially over all drafting devices 25, 25*a*, 25*b* present of the respective group, as is indicated schematically in FIG. 6 for the withdrawal roller 35*a*. Finally, FIGS. 5 and 6 show that a respective spinning device 21 according to FIG. 4 can connect to the withdrawal rollers 35*a*, 35*b* of pair IV.

To also allow the operator 5 (FIG. 1) to have easy access to essential function parts, where necessary, when using the folding drafting devices 25, 25*a* and 25*b* according to FIGS. 5 and 6, these drafting devices 25, 25*a* and 25*b* are configured as further details in FIGS. 5 and 6 show.

According to FIG. 6 the distance between the individual drafting devices 25, 25*a* and 25*b* transversely to the transport direction 26 is selected so that the press arms 44 supporting the driven rollers 28*b*, 29*b* can be pivoted to the side or selectively opened and closed around a respective vertical pivot pin 48 disposed in the housing 46, like rollers 28, 29, in the direction of a double arrow x. Therefore, if the drafting devices 25, 25*a* and 25*b* are arranged in a similar manner to FIGS. 3 and 4, so that the axes of the feed rollers 28*a*, 28*b* stand vertically, then, as in FIG. 4, all the press arms 44 can not only be arranged within the reach of the operator 5, but can also be operated by him/her without leaving the work area 4.

In addition, FIG. 5 shows that the driven roller 35*b* is rotatably disposed on a further structural element in the form of an arm 50, which with a pivot pin 51 is disposed to be able to pivot on a part of the housing 46 lying right at the front in the transport direction 26. The pivot axis is arranged parallel to the rotational axis of the roller 35*b*. Therefore, the roller 35*b* in FIG. 5 can be pivoted downwards in accordance with the double arrow v out of the drafting device 25 into a position indicated in dot-dash lines, in which the function part 35*b* and the exit gap between the aprons 34*a*, 34*b* are accessible. Moreover, the assemblies supporting the aprons 34*a*, 34*b* are also mounted on a pivoting arm 52. The arm 52 is disposed to pivot on a rear portion of the housing 46 opposed to the arm 50 by means of a further pivot pin 53, the pivot axis of which is extended parallel to the pivot axis of the pivot pin 51. Therefore, the arm 52 and with it the apron assemblies according to FIG. 5 can be pivoted back and forth in the direction of a double arrow z and for replacement of the aprons 34*a*, 34*b* or the like can be pivoted out of the drafting device 25 into a position shown in dot-dash lines. Moreover, the arrangement is such that the arm 50 can be pivoted counterclockwise and the arm 52 can be pivoted clockwise into the open position, so that firstly the roller 35*b* and then without hindrance also the apron assembly can be pivoted into the open position.

Figure 4A:
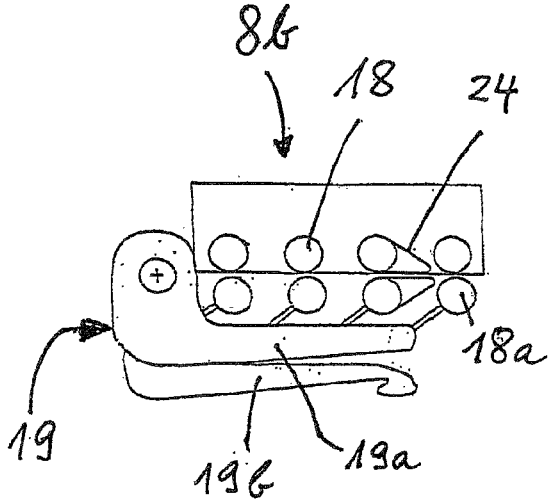
FIGS. 4*a* and 4*b* schematically show a drafting device of the circular knitting machine according to FIG. 4 with a usual press arm, respectively in a closed and open position, on an enlarged scale.
Figure 4B:
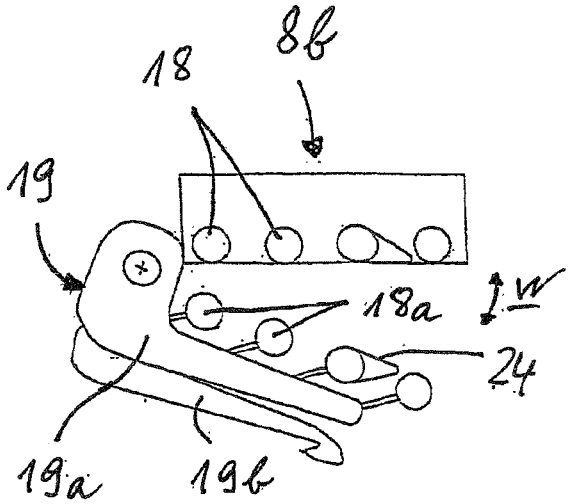

After any maintenance or repair work has been conducted, the arms 50, 52 are pivoted back into the operating position and fixed with locking means (not shown) in the housing 46, as also applies to the press arms 44 (FIG. 6) that are provided with usual locking means and could be configured, for example, in accordance with FIGS. 4*a* and 4*b*.

Moreover, in a manner not shown further, the arms 50, 52 are configured by means of springs, pneumatically or otherwise as press arms, which press the driven rollers or the like mounted on them against the associated driving rollers or the like.

As is indicated on the far right in FIG. 5, the drafting device 25 is preferably arranged at an angle of between 90° and 180° relative to the knitting needles 30, so that approximately the angled position shown in FIG. 1 for the drafting device 8 results. In this position, the pair I of feed rollers 28*a*, 28*b* is arranged slightly higher above the head of the operator 5 than the pair IV of withdrawal rollers 35*a*, 35*b*. Thus, the operator can selectively pivot the press arms 44 to the side and/or the arms 50, 52 downwards to open the drafting device 25 with simple movements of the hand and without leaving the work area 4. Corresponding conditions also result for the other drafting devices 25*a* and 25*b*, as FIG. 6 shows.

It is particularly advantageous to couple the two rollers 31*a* and 31*b*, over which the aprons 34*a*, 34*b* run, by spur gears (not shown) situated in engagement, for example, at a location 54 (FIG. 5). As a result of this, it is also possible to forcibly drive the upper rollers 31*b*, which are normally only entrained by frictional force in FIG. 5, by positive locking. For this the driving roller 31*a* of the (lower) apron 34*a* in FIG. 5 is expediently driven by means of a toothed belt indicated by arrows r, which is laid around a toothed pulley 55, the rotational axis of which coincides with the pivot axis of the pivot pin 53. The toothed pulley 55 is preferably fastened to a shaft, which is perpendicular to the feed rollers 28*a*, 28*b* and passes through the entire drafting device group and from which the drives for the rollers 31*a* of the other drafting devices 25*a*, 25*b* etc. are also derived.

It is additionally advantageous to provide the rollers 31*a*, 31*b* on the periphery with radial pins 56 (FIG. 6), which engage in holes 57 formed on the edges of the aprons 34*a*, 34*b* and arranged one behind the other in the transport direction 26. This enables both aprons 34*a*, 34*b* to be forcibly driven completely free from slippage, which promotes a uniform attenuation of the fibre material 27.

In addition, FIG. 5 schematically shows how despite the foldable arrangement of the different function parts, a suction/blower system can be provided to keep the drafting device 25 substantially free from fluff or the like. For this purpose, on both sides of the withdrawal rollers 35*a*, 35*b* at least one respective blower nozzle 58 is provided, into which blast air is introduced in the direction of the entered arrows. As a result, the rollers 35*a*, 35*b* remain substantially free from fluff. The exiting blast air flow is directed over filler pieces 59, which are arranged on the rear side of the rollers 35*a*, 35*b* close to the exit gap between the aprons 34*a*, 34*b* and serve to optimise the blast air flow, onto the returning run of the aprons 34*a*, 34*b*. From there the air flow is fed via air ducts 60 and 61, which are configured on the lower and upper side of the housing 46 enveloping the drafting device 25 and in which a slight underpressure expediently prevails, to a central extraction means. To allow a pivoting movement of the arm 52 in spite of the lower air duct 60, the air duct 60, as separation points 60*a* in a front and rear region indicate, has a central section 60*b*, which is fastened to the arm 52 in such a way that it can be pivoted together with this and the apron assemblies out of the housing 46 in the direction of arrow z (FIG. 5). Moreover, the filler pieces 59 are expediently mounted on arm 50 or 52 so that they do not disturb the pivoting movements thereof.

In addition, FIG. 6 shows that two further filler pieces 62 are respectively arranged in the pre-drafting zone 41 between the rollers 28*a*, 29*a* and 28*b*, 29*b* and between them form guide channels 63 for the fibre material 27. The automatic threading of the fibre material 27 in the substantially closed drafting device 25 is substantially simplified as a result of this. The same applies to the other drafting devices 25*a* and 25*b*.

Finally, a distance dimension 64 in FIG. 6 shows that the guidance of the folded fibre material 27 through the roller pair IV expediently does not occur exactly centrally compared to the fibre path in the roller pairs I and II. As the rollers 35*b* (FIG. 5), which are generally covered with a rubber layer, are subject to a certain amount of wear because of the high rotational speeds of e.g. 2000 rpm to 4000 rpm, the rollers 35*b* can be reversed where necessary. The running time of the rollers 35*b* can also be doubled as a result of this without any expensive changeover.

If necessary, the drafting device according to FIGS. 5 and 6 can also be arranged in a position that is pivoted 90° around the longitudinal axis such that the arms 50, 52 can be pivoted to the side and the press arms can be pivoted downwards.

Figure 7:
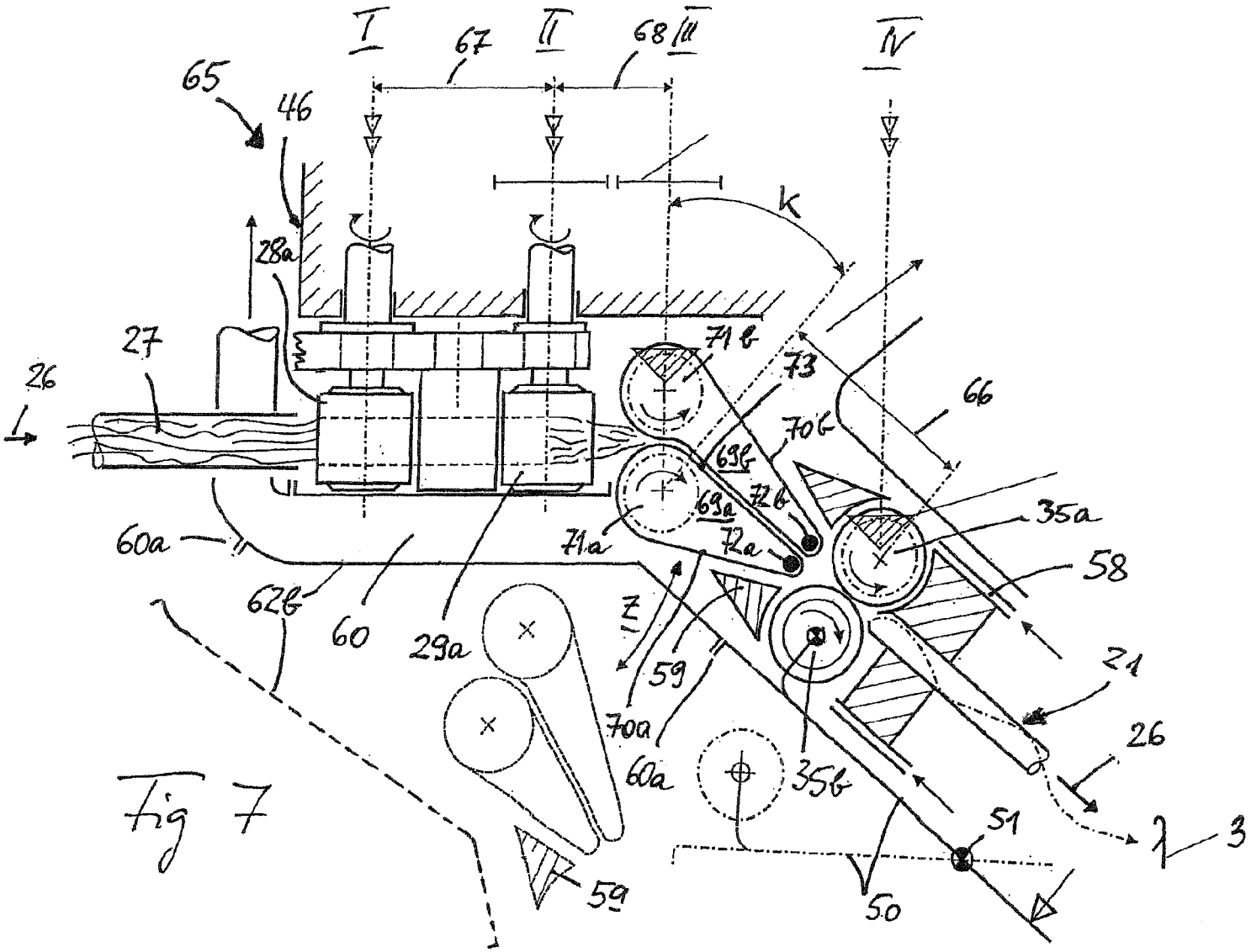
FIG. 7 shows a longitudinal section through a drafting device for the circular knitting machine of FIG. 3 according to a second exemplary embodiment.

FIG. 7 shows a further exemplary embodiment for a drafting device 65 according to the invention, which in a similar manner to FIGS. 3 and 4 is particularly suitable for a segment design, in which the number of the drafting devices combined to form one structural unit is comparatively small in comparison to the bar solution according to FIGS. 1 and 2, and amounts to two, for example. The drafting device 65 substantially corresponds to the drafting device 25 according to FIGS. 5 and 6, but differs from this through a characteristic angled or sloping position of a main drafting zone 66 in the region of a bend K. The function parts in a pre-drafting zone 67 and a folding zone 68 in FIG. 7 are configured and arranged in a substantially identical manner to FIGS. 5 and 6, and are therefore provided with the same reference numerals. Like therein, the fibre materials 27 are thus guided through the pre-drafting and folding zones 67, 68 parallel to the floor 7 (FIGS. 1 and 3) and perpendicularly to the knitting needles 3 before they are fed into apron assemblies 69*a*, 69*b*. Two respective aprons 70*a* and 70*b* of these assemblies 69*a* and 69*b* are laid around two rollers 71*a*, 71*b* and two deflection elements 72*a*, 72*b* and between them form guide paths 73, which begin at the exit of the rollers 29*a*, 29*b* about at the height of the path predetermined by the transport direction 26 and are then extended on an angle downwards in the direction of the deflection elements 72*a*, 72*b* located at a lower level. The angle of inclination amounts to approximately 45° to the floor 7, for example. The main drafting zone 66 with the parts 35*a*, 35*b*, 50, 51, 58 and 59 adjoins the rollers 71*a*, 71*b* taking into consideration this angle of inclination in substantially the same manner as in FIG. 5. Because of the bend K formed by the described angled position in FIG. 7, the occurring fibre flows are introduced into the knitting needles 3 on an angle. A difference with respect to FIG. 5 resulting from FIG. 7 is therefore that while the threads discharging from the drafting devices 65 can be introduced into the knitting needles 3 on an angle as in FIG. 5, the pivoting press arms 44 (FIG. 6) and the arms 52 are at the same time located lower than in FIG. 5 and are therefore even more easily accessible for the operator 5 without restricting his/her head clearance.

A further exemplary embodiment of a drafting device 74 according to the invention that is particularly expedient for practical application is evident from FIGS. 8 to 12. According to FIG. 8 the support ring 15 of the circular knitting machine 1 configured in accordance with FIG. 1 is provided on its outer periphery with vertical mounting plates 75, which serve to fasten a plurality of drafting devices 74. For this purpose, each drafting device 74 has a flange plate 77 on a front side of a drafting device housing 76 (cf. in particular FIG. 11), which is fastened to one of the mounting plates 75 with fastening screws 78 and locating pins 79.

The drafting device 74 is configured analogously to FIG. 7 and according to FIGS. 9 to 12 is provided with four pairs I to IV of drafting device elements. The first pair I includes two feed rollers 80*a* and 80*b*, which with rollers 81*a*, 81*b* of the second pair II form a pre-drafting zone, whereas the fourth pair IV includes two withdrawal rollers 82*a*, 82*b*. During operation (FIG. 8) the rollers 80*a*, 80*b* and 81*a*, 81*b* stand vertically, whereas rollers 82*a*, 82*b* stand horizontally. Arranged between the rollers 81*a*, 81*b* and 82*a*, 82*b* are two apron assemblies 83*a* and 83*b*, which analogously to FIG. 7 have rollers 84*a* and 84*b*, deflection elements (not further shown) associated with these and also aprons 85*a* and 85*b* guided on these. Analogously to FIG. 7, the rollers 84*a*, 84*b* form a folding zone with rollers 81*a*, 81*b* and are therefore arranged horizontally during operation like the withdrawal rollers 82*a*, 82*b* and the deflection elements that are not shown. The aprons 85*a*, 85*b* form a guide path 86 (FIG. 9) between them, which like the guide path 73 in FIG. 7 is arranged on an angle to a rotational axis 87 (FIG. 8) of the needle cylinder 2 and to the knitting needles 3. A feed funnel or trocar 88, through which the fibre material (not shown) is fed into the clamping gap between the feed rollers 80*a*, 80*b*, is located at the inlet of the drafting device 74. Moreover, in accordance with the above explanations the conditions are selected so that the fibre material is folded, for example, in a V-, N- or W-shape in the folding zone between the rollers 81*a*, 81*b* and 84*a*, 84*b* before it is fed by means of the aprons 85*a*, 85*b* to the exit gap between the withdrawal rollers 82*a*, 82*b* and is subjected to the main drafting operation by these. The fibre material discharging from the exit gap is then preferably converted by means of a spinning device 21 (cf. FIGS. 4, 7 and 8) or another spinning element into a temporary yarn and transported to the knitting needles 3.

Figure 8:
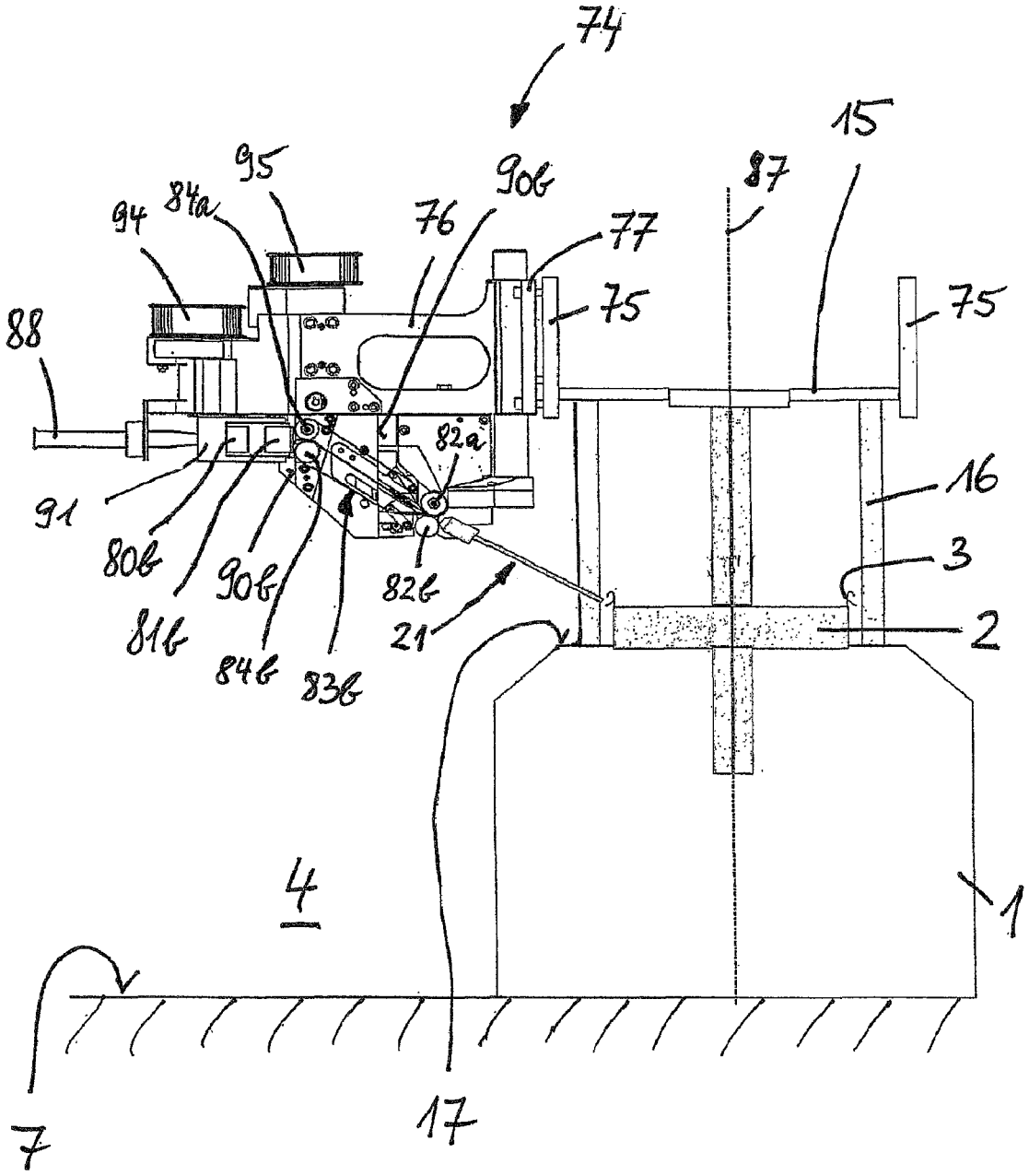
FIG. 8 is a schematic side view through a third exemplary embodiment of a circular knitting machine according to the invention.
Figure 9:
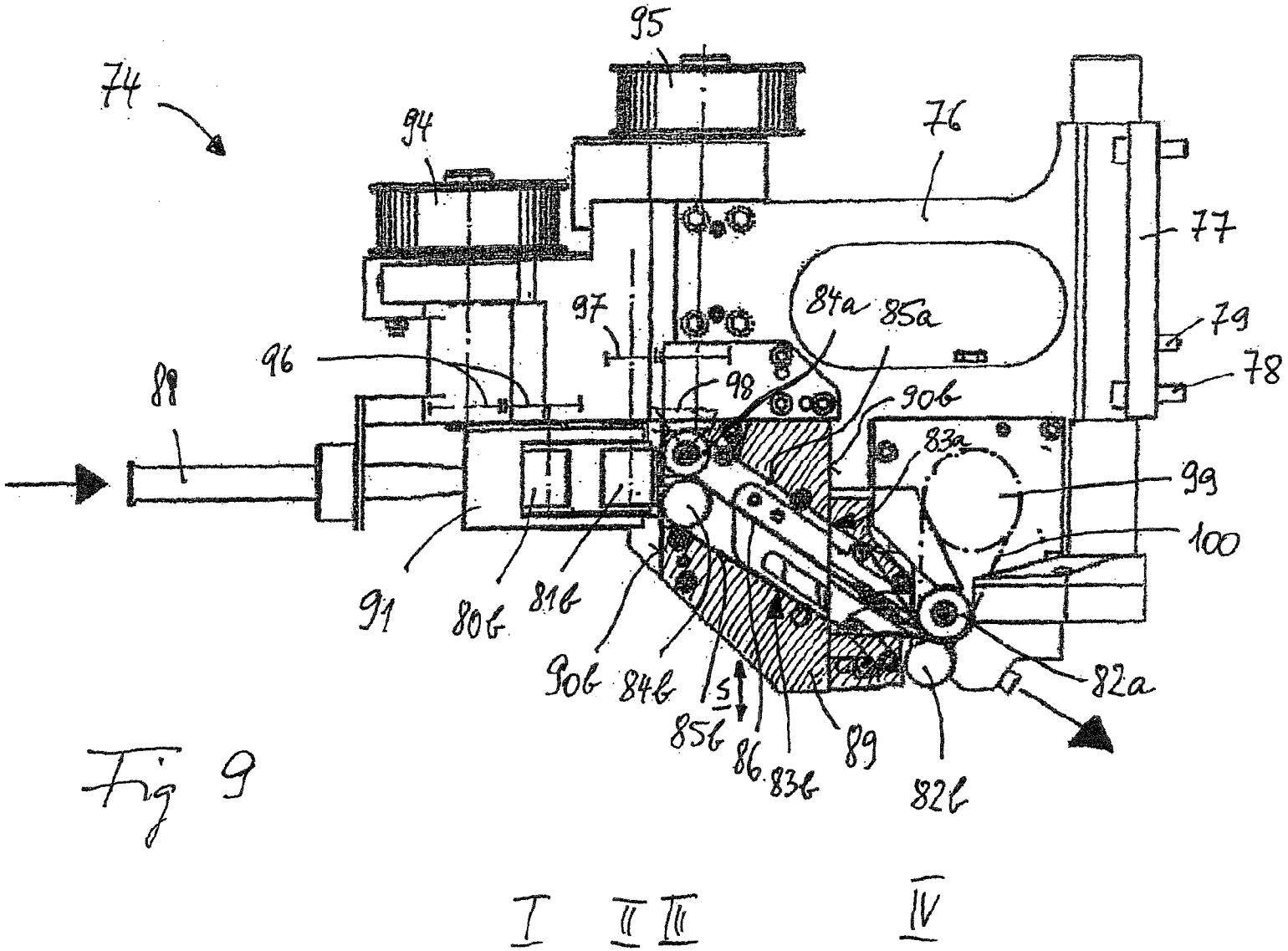
FIG. 9 is an enlarged side view only of one drafting device of the circular knitting machine according to FIG. 8.
Figure 9A:
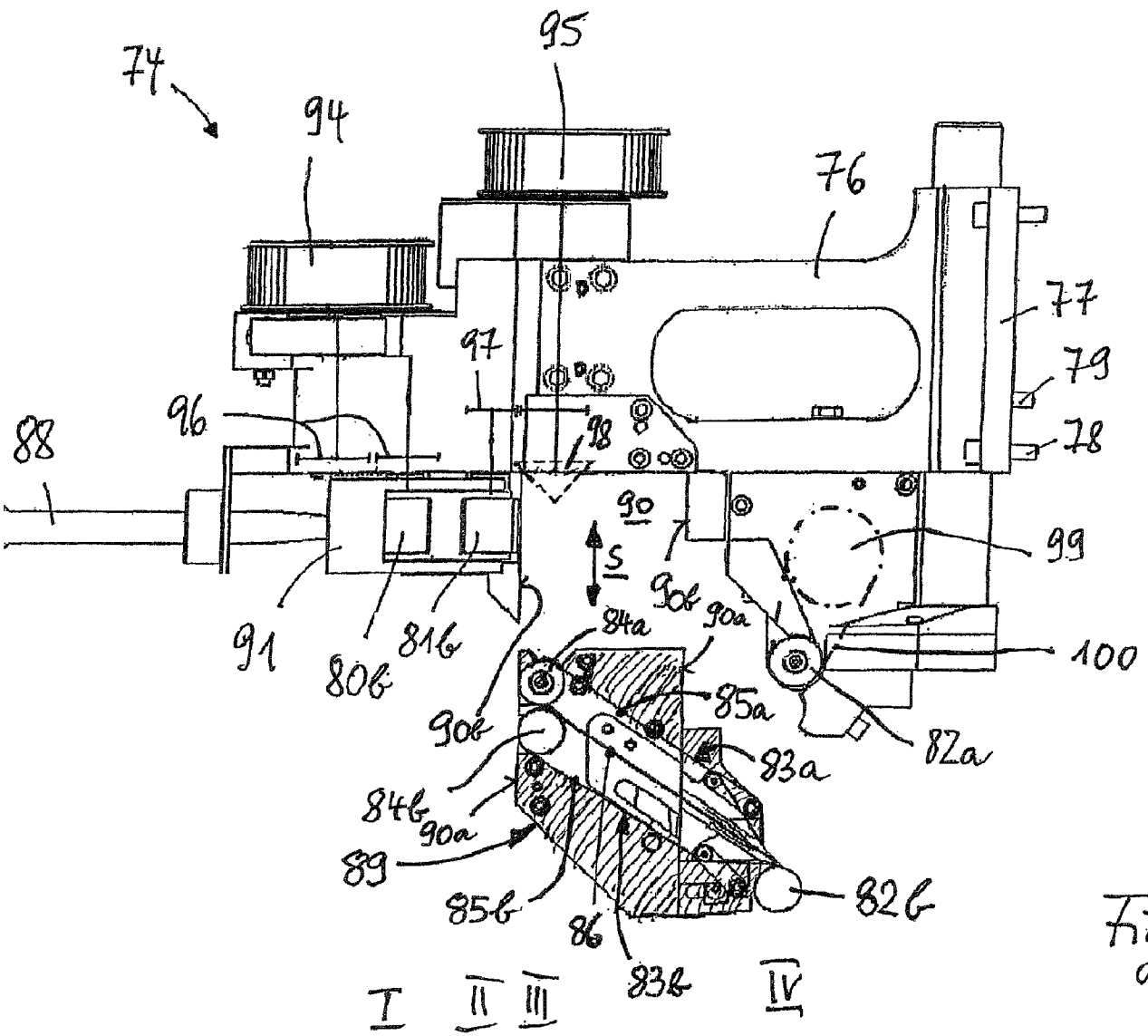
FIG. 9*a* is a slightly smaller representation compared to FIG. 9 of the drafting device after an insertion part has been removed downwards.

A special feature of the drafting device 74 is that it can be at least partially opened by at least the apron assemblies 83 being mounted completely on a structural element in the form of an insertion part 89, which is configured in the shape of a module and is made more clearly visible by hatching in FIGS. 9, 9*a*, 11 and 12. This insertion part 89 sits in a downwardly open recess 90 (FIG. 9*a*) of the housing 76 and—viewed in the transport direction of the fibre material—has respective guide surfaces 90*a* (FIG. 9*a*) as front and rear boundaries that cooperate with corresponding guide surfaces 90*b* (FIGS. 8, 9 and 9*a*) defining the recess 90. As FIGS. 8 and 9, 9*a* show, the guide surfaces 90*b* stand vertically during operation. Therefore, the insertion part 89, including the two apron assemblies 83*a*, 83*b*, can be pulled downwards out of the drafting device 74 in the direction of a double arrow s (FIG. 9), as is shown in FIG. 9*a*, or can be inserted again. Therefore, if, analogously to FIG. 3, the drafting device 74 is arranged above the stitch-forming points 6, but within the reach of the operator 5, then it is possible for him/her without leaving the work area 4 to pull out the insertion part 89 downwards in order to maintain and/or repair the function parts contained in the apron assemblies 83. Alternatively, instead of the position of the guide surfaces 90*b* parallel to the rotational axis 87 (FIG. 8), an angled position to the rotational axis 87 can also be provided, in which case the insertion part 89 could be pulled out downwards on an angle.

Otherwise, it is clear that the housing 76 and the insertion part 89 can be provided with interacting locking elements, which have been omitted for better clarity, and possibly also with further positioning elements to position and fix the insertion part 89 correctly in the drafting device 74 in the working position evident from FIG. 9. Moreover, the lower driven withdrawal roller 82*b* in FIG. 9 is preferably also mounted on the insertion part 89 (cf. FIG. 9*a*), so that its position relative to the driven aprons 85*b* can be easily adjusted when the insertion part 89 is pulled out. Apart from this, it is clear that the insertion part 89 can be provided with spring elements or the like (not shown) in order to press the driven apron assemblies 83*b* against the driving apron assemblies 83*a*.

Figure 10:
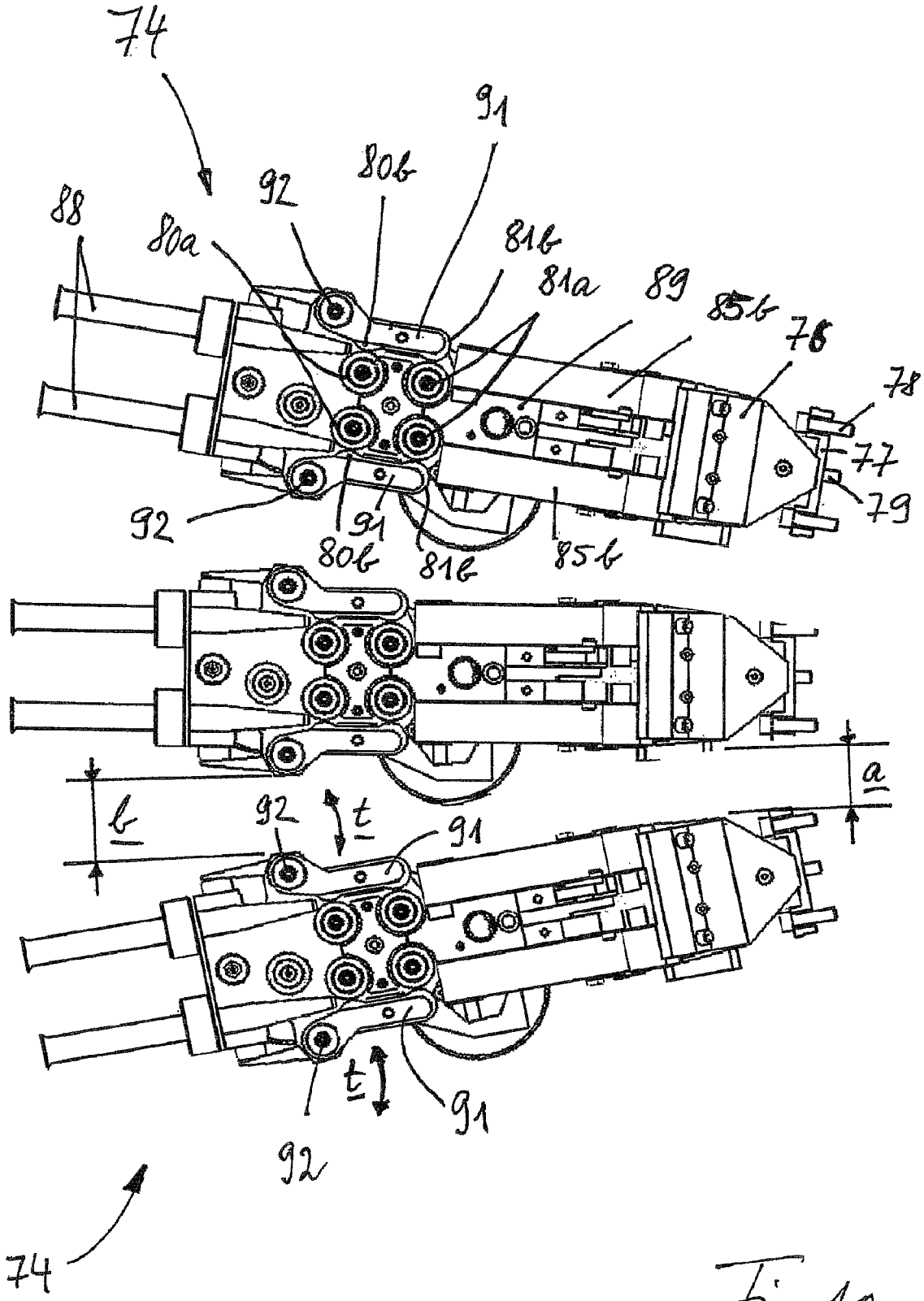
FIG. 10 is a bottom view of three drafting devices arranged adjacent to one another on the periphery of the circular knitting machine according to FIG. 8, which is not shown.
Figure 11:
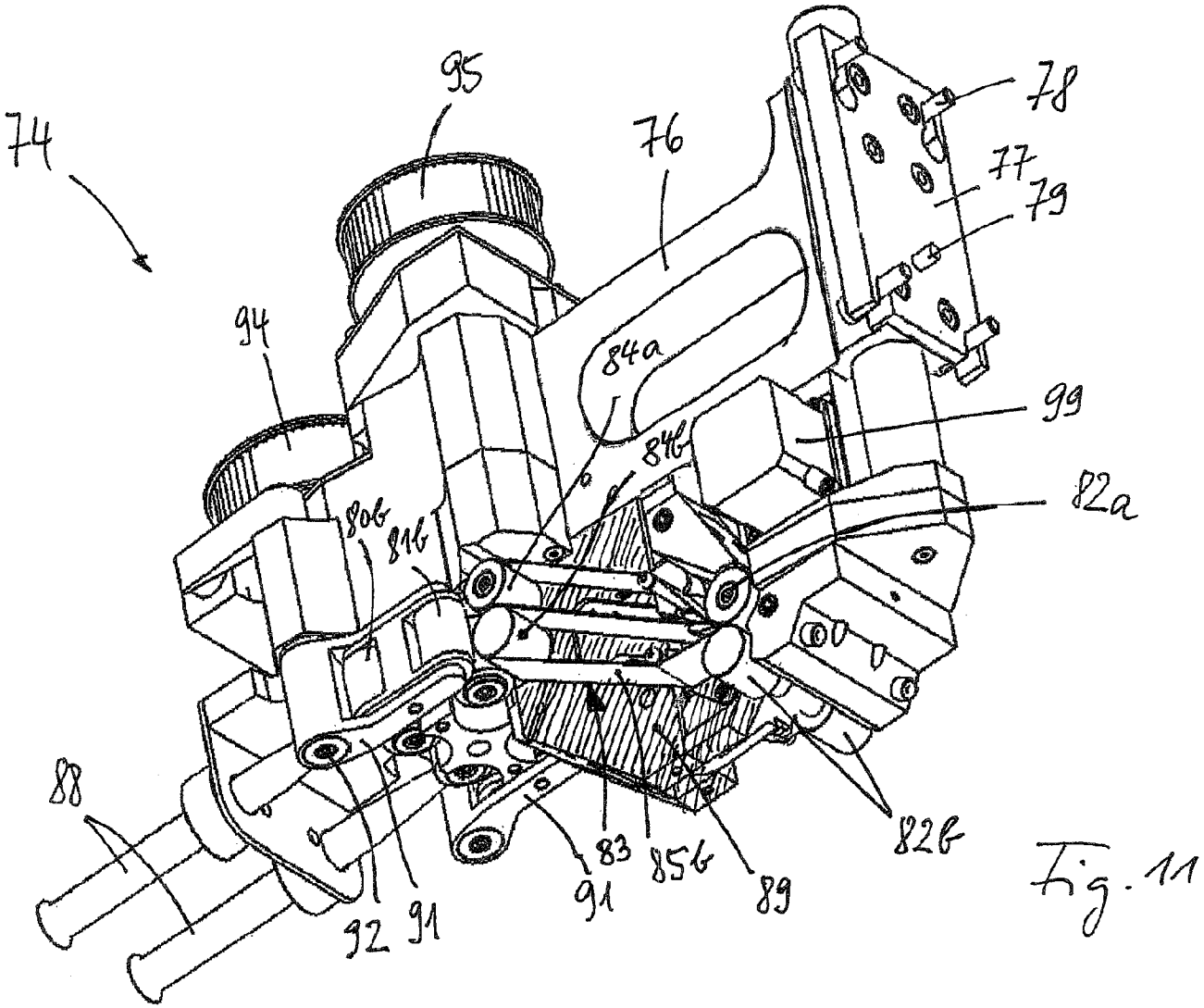
FIGS. 11 and 12 are two perspective views of the drafting device according to FIG. 9, viewed from below.
Figure 12:
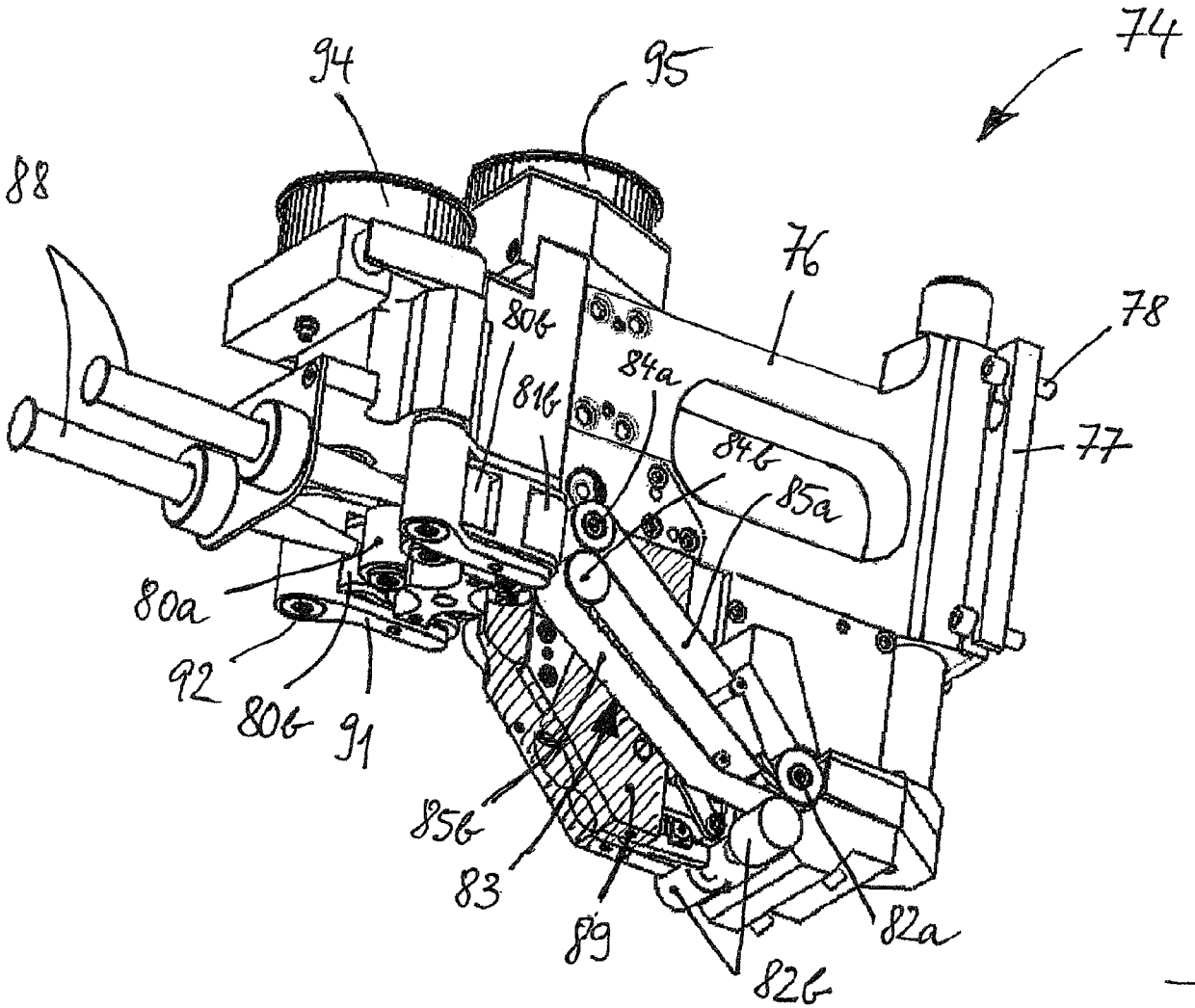

As shown in particular in FIGS. 10 to 12, two drafting device sections are preferably arranged next to one another in tandem configuration in each drafting device 74 in a similar manner to FIG. 3. Therefore, the drafting device 74 has two feed funnels 88, two pairs of feed rollers 80*a* and 80*b*, two aprons 85*a*, 85*b* etc., so that two fibre materials can be attenuated simultaneously in parallel operation and fed to adjacent knitting points of the circular knitting machine 1. In this case, the driven rollers 80*b* of the pairs I are expediently arranged respectively on the outside of the housing 76 and there are rotatably disposed on pivoting press arms 91 (e.g. FIGS. 10 and 11). The press arms 91 can be pivoted in a manner known per se to the side and outwards in the direction of arrows t (FIG. 10) around pivot pins 92 (FIGS. 10, 11) that are vertical during operation, as also applies accordingly for the press arms 44 shown in FIG. 6. Therefore, in the case of the exemplary embodiment according to FIGS. 8 to 12, the function parts can be made accessible by pulling out the insertion part 89 downwards and/or pivoting the press arms 91 to the side. If it is desirable to make at least the driven withdrawal rollers 82*b* accessible independently of the other function parts, they can be mounted on a separate downward pivoting arm, analogously to FIG. 7. Moreover, the press arms 91 can be configured in accordance with FIGS. 4*a* and 4*b*.

Finally, FIG. 10 also shows that the drafting devices 74 can be arranged very closely adjacent to one another. Because of the described segment design, they lie radially to the centre axis 87 (FIG. 8) of the needle cylinder 2 and therefore at the location where the threads exit have their smallest spacing a, whereas they have larger spacings b at the location where the fibre materials are fed. In association with the tandem design and despite the fact that the press arms 91 must be capable of pivoting to the side, this allows a comparatively substantial package density of the drafting devices 74 on the periphery of the needle cylinder 2 with the consequence that, even if the knitting machine 1 is provided with 72 or even 96 knitting points, the spinning devices 21 (FIG. 3) only require comparatively short transport tubes 23 and only need a single twist element 22, which is associated with a substantial energy saving.

In the exemplary embodiment of FIGS. 8 to 12 the drive for the driving rollers 80*a*, 81*a* of the first and second pair I and II is achieved by means of vertically standing drive shafts, onto which toothed pulleys 94, 95 are drawn. This enables both toothed pulleys 94, 95 to be driven by means of a respective toothed belt, which surrounds the rotational axis 87 of the needle cylinder 2 essentially in a circular shape. Therefore, only one respective drive motor is required for all the rollers 80 and 81 present on the periphery of the circular knitting machine 1. The desired transmission ratio and the necessary direction of rotation can be set by means of spur gears 96, 97 (FIG. 9). In contrast, the drive for the driving rollers 84*a* of the apron assemblies 83*a* is transmitted onto the horizontally lying shafts of these rollers 84*a* by means of bevel gears 98 indicated schematically in FIG. 9 of the drive shaft of the toothed pulley 95. In particular, the arrangement is expediently such that these bevel gears 98 at the same time represent couplings, which cooperate with corresponding bevel gears on the shafts of the rollers 84*a*. Therefore, when the insertion part 89 is pulled out of the drafting device 74 (FIG. 9*a*) the separation thereof is automatically effected by the drive. However, if the insertion part 89 is run into the drafting device 74 again, then the cooperating bevel gears are automatically coupled to one another with respect to drive.

The driving rollers 82*a* of the withdrawal rollers IV, if they are also to be driven by means of vertically standing shafts, would likewise have to be coupled to these shafts via bevel gears. This could lead to problems in view of the high rotational speeds of these rollers 82*a*, 82*b*, or require costly transmissions. Therefore, it is provided according to the invention to provide the driving withdrawal rollers 82*a* of the folding drafting devices 25, 65 and 74 with drives associated individually with them. This is indicated schematically in FIGS. 9 and 9*a*, according to which a motor 99 is housed in the housing 76 and coupled with respect to drive via a toothed belt 100 to a toothed pulley, which sits on the shaft of the driving withdrawal roller 82*a*. Naturally, both (or more) withdrawal roller pairs IV can be driven with the same motor 99 if the drafting devices 74 are arranged for processing two (or more) fibre materials in parallel, as in FIGS. 8 to 12.

Figure 13:
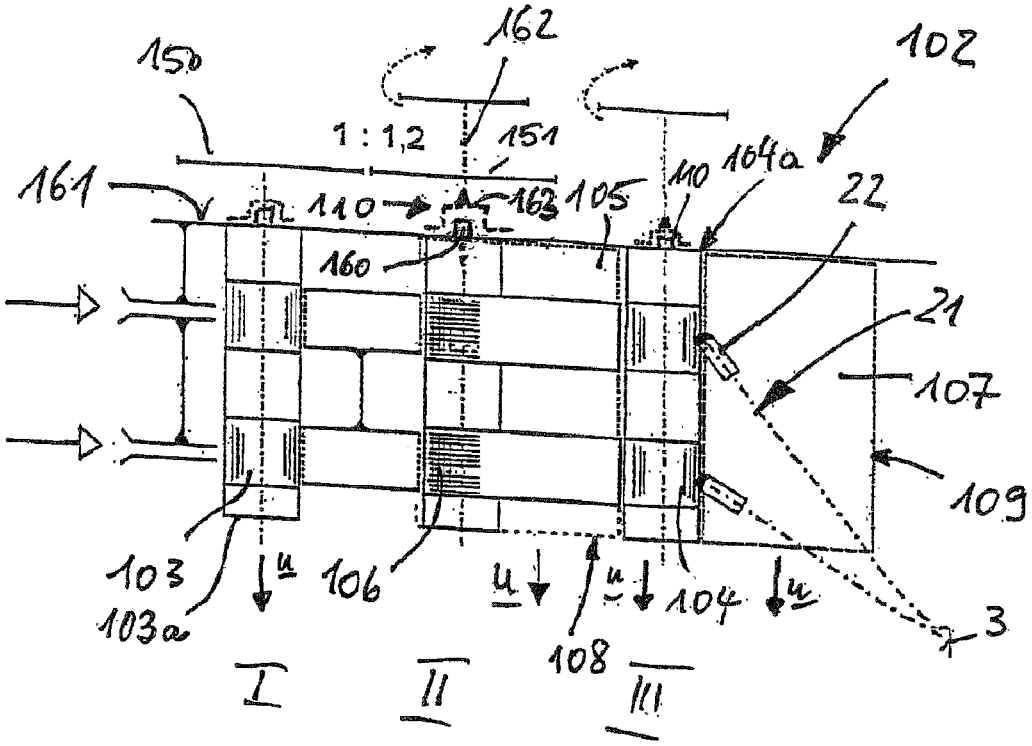
FIGS. 13 to 16 are purely schematic representations of exemplary embodiments for further drafting devices according to the invention with insertion parts.

FIG. 13 shows as exemplary embodiment a 3-roller drafting device 102 according to FIG. 3 with two drafting device sections working in parallel, which each have a pair I, II and III of drafting device elements, wherein in FIG. 13 only one of the drafting device elements present in pairs is respectively visible. Each drafting device section contains two feed rollers 103, two withdrawal rollers 104 and two respective apron assemblies 105 between these, each having a roller 106. As in FIG. 3, all the drafting device elements are arranged parallel to one another and have rotational axes that stand vertically during operation, as is indicated respectively by dot-dash lines. In addition, adjoining the withdrawal rollers 104 is a nozzle assembly 107 consisting substantially of a closed housing, in which air nozzles (not shown further) intended for blowing on the withdrawal rollers 104 as well as extraction ducts for loose fibres and air supply means for the pneumatic twist elements 22 of the spinning devices 21 can be housed. As is indicated by broken lines, the apron assemblies 105 and the nozzle assembly 107 are respectively configured as insertion parts 108, 109, which can be pulled downwards out of the drafting device 102 in the direction of the arrows u. The configuration of the insertion parts 108, 109 can be selected analogously to FIGS. 9 and 9*a*. As a schematically indicated coupling 110 for the insertion part 108 shows, the apron assemblies 105 can be decoupled when the insertion part 108 is pulled out by drive elements located above this, the shaft members of which are arranged parallel to those of the rollers 106. In a corresponding manner, the feed rollers 103 and the withdrawal rollers 104 can also be arranged in a respective insertion part 103*a*, 104*a*, which is connected with a further coupling 110 to the drive or is decoupled from this.

Alternatively, the driven rollers of pair I, also analogously to FIGS. 8 to 12, can be disposed on a common press arm (not shown) that can be pivoted to the side and that could also be replaced by two individual press arms.

Figure 14:
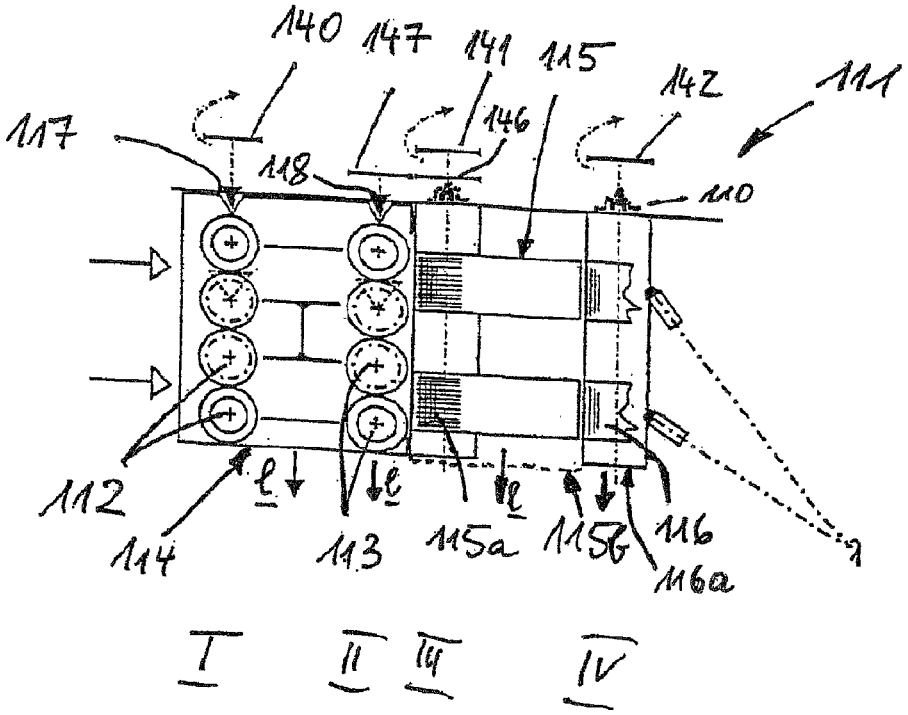

The exemplary embodiment according to FIG. 14 differs from that according to FIG. 13 in that it is configured as a 4-roller folding drafting device 111 without bend K (FIG. 7). Here, feed rollers 112 of the first pair I that are horizontal during operation and rollers 113 of the second pair II, which are also horizontal during operation and form the pre-drafting zone with said feed rollers, are arranged in a module forming an insertion part 114. This can be configured and arranged analogously to FIGS. 9 and 9*a* and be pulled out downwards in the direction of an arrow l. As a result of this, it is possible to make the space in front of the following apron assemblies 115 of the drafting device 111 completely free.

The axes of the feed rollers 112 and the rollers 113 of the pair II are arranged horizontally here, whereas the axes of the apron assemblies 115 and of withdrawal rollers 116 are arranged vertically. Therefore, as indicated in FIG. 9 for rollers 84*a*, the driving rollers of pairs I and II, are driven e.g. by means of bevel gears 117, 118, which mesh with further bevel gears sitting on the shafts 112, 113 and at the same time serve as couplings when the insertion part 114 is pulled out or inserted. As a consequence of this, the rollers 112, 113 are automatically coupled to a drive (not shown further) explained further below or decoupled from this during the movements of the insertion part 114.

The driven drafting device elements of the apron assemblies 115 and the withdrawal rollers 116 can be disposed analogously to FIG. 4 on? press arms or the like that can be pivoted away to the sides of the drafting device 111. However, a particularly preferred embodiment results when the apron assemblies 115 and the withdrawal rollers 116 are fastened, analogously to FIG. 13, to insertion parts 115*b* or 116*a*, which can be pulled away downwards in the direction of the arrows l.

Figure 15:
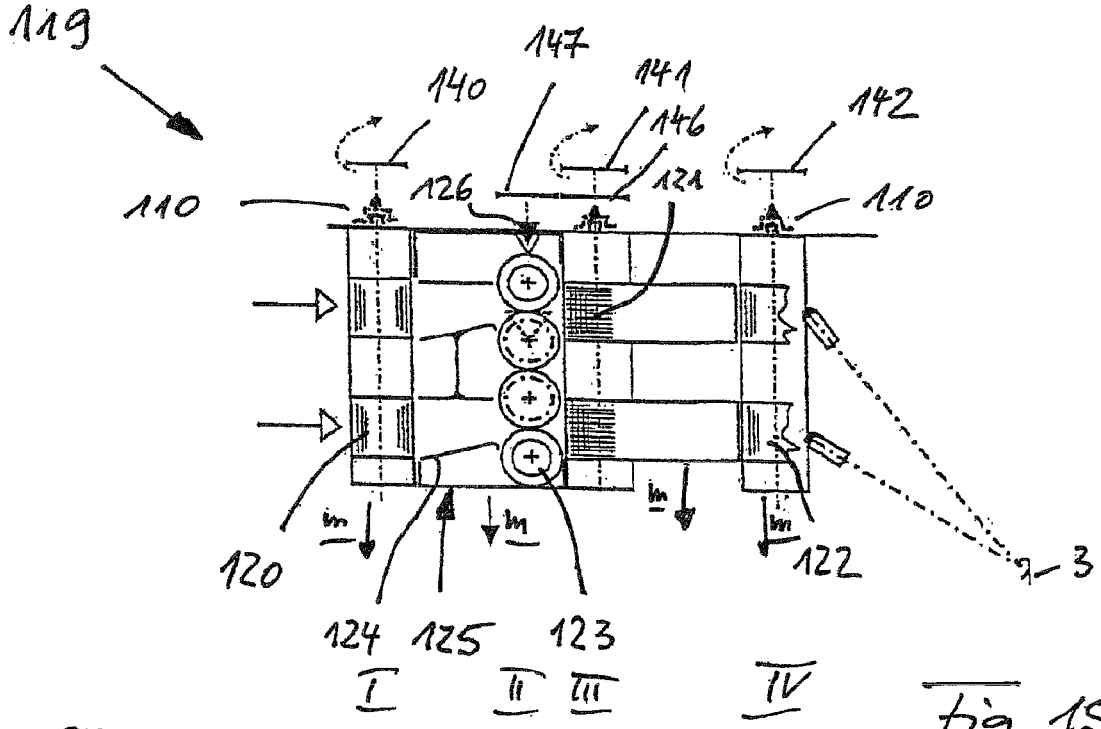

FIG. 15 shows a 4-roller drafting device 119, which is currently considered to be the best exemplary embodiment of the invention and differs from that according to FIG. 14 in that the axes of feed rollers 120, apron rollers 121 and withdrawal rollers 122 are all arranged vertically during operation, whereas further rollers 123 arranged between the feed and apron rollers 120, 121 have horizontally located axes. In order to prevent the fibre materials from being folded between the rollers 120, 123 of the first and second pair I and II, even though these are arranged perpendicular to one another, the distances between the nip lines of these rollers in relation to the width of the feed sliver are selected so that the above-explained conditions that are necessary for folding are not met, in that, for example, the spacings of the nip lines are selected to be substantially larger than the widths of the slivers. Moreover, guide elements 124 or the like arranged on an angle or curved in a helical shape over an angle of 90° can be provided between the rollers 120 and 123 that prevent folding, while promoting a mere deflection of the sliver around 90°.

An advantage of the drafting device 119 according to FIG. 15 is that during operation the axes of the rollers 123 can be arranged horizontally, while all the other rollers can be arranged vertically, as is preferred for reasons of a simplified drive, as will be explained in more detail below. The horizontal rollers 123 and possibly the guide elements 124 are expediently housed in an insertion part 125, which can be pulled downwards out of the drafting device 119 in the direction of an arrow m, as also applies for the other function parts. Therefore, all rollers of the pairs I, II, III and IV are mounted here on the insertion parts or the like evident from FIGS. 13 and 14. Finally, only a single bevel gear 126 associated with the insertion part 125 and the rollers 123 is necessary, which at the same time serves as a coupling, whereas all the other insertion parts are coupled to the drive by means of the couplings 110.

Figure 16:
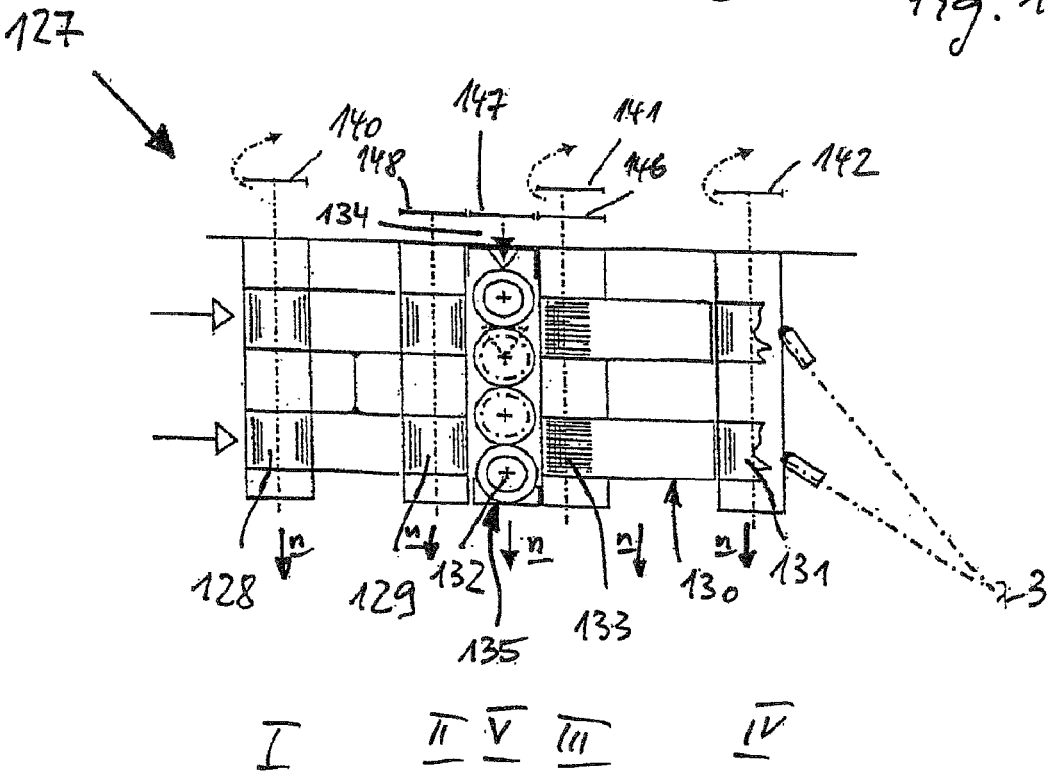

FIG. 16 finally shows an exemplary embodiment for a drafting device 127, which is provided with vertically arranged rollers 128 and 129 in the region of pairs I and II. Analogously to FIG. 15, in the region of drafting device elements III and IV the drafting device 127 additionally has two respective pairs of apron assemblies 130 and withdrawal rollers 131, the axes of which are also arranged vertically during operation. However, an additional pair V of drafting device elements comprising horizontally arranged rollers 132 is provided between the drafting device pairs II and III. In this case, the conditions are selected, on the one hand, in such a way that the rollers 129 and 132 form a folding zone in the sense of folding zone 43 according to FIG. 5, for example, by adjusting the starting width of the sliver in the nip line of the rollers 129 to 16 mm and the spacing of the nip lines between the rollers 129 and 132 to about 30 mm, so that a W-shaped fold results and the sliver leaving the rollers 132 only has a width of approximately 4 mm. On the other hand, the distance between the nip lines of rollers 132 and rollers 133 of the apron assemblies 130 is likewise adjusted to be sufficiently large, e.g. to 30 mm, compared to the still only approximately 4 mm wide sliver so that no new folding results here. It would also be conceivable to arrange guide plates corresponding to the guide elements 124 according to FIG. 15 between rollers 132 and 133. Otherwise, the drafting device 127 can be formed simply by additionally installing the rollers 132 between the rollers of the second and third pair of a conventional 4-roller drafting device.

The exemplary embodiment according to FIG. 16, like the exemplary embodiment according to FIG. 15, additionally has the advantage that only one drive bevel gear 134 is required to drive the rollers 132, since the shaft members of all the other rollers 128, 129, 131 and 133 can be arranged vertically during operation and can be connected by means of the couplings 110. Therefore, it is generally sufficient to only dispose the rollers 132 in an additional insertion part 135, which can be pulled downwards out of the drafting device 127 in the direction of an arrow n, whereas the remaining roller pairs can be disposed, analogously to FIGS. 13 to 15, on the insertion parts described therein. Apart from this, it is clear that the exemplary embodiments according to FIGS. 14 to 16 could also be provided with a nozzle assembly 107.

Figure 17:
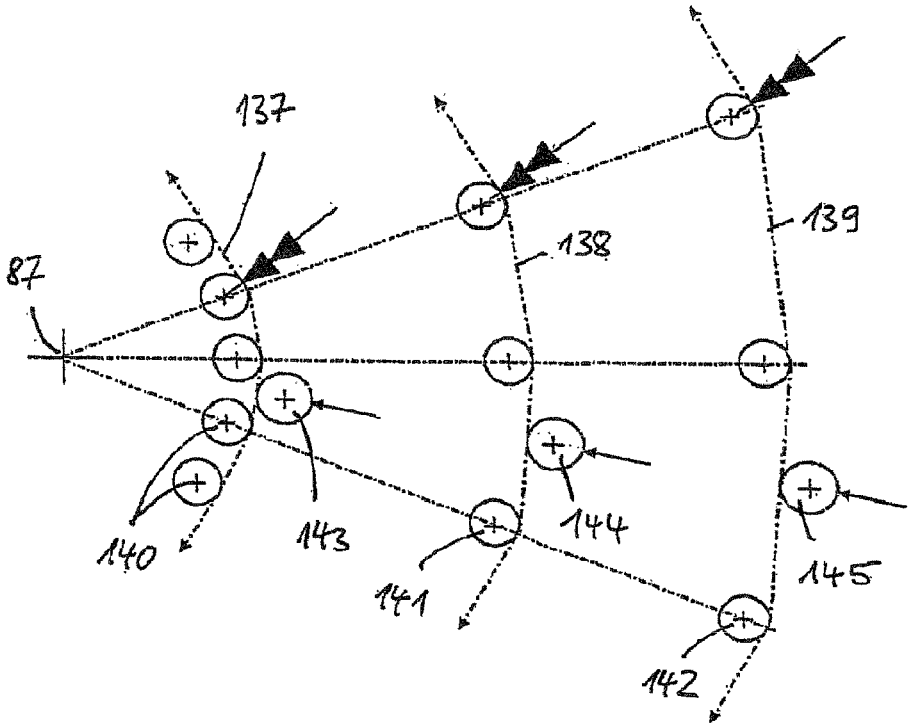
FIG. 17 is a plan view onto a drive means for the drafting devices.

The drive of the described drafting devices can be performed in a usual manner for drafting devices. When they are applied to circular knitting machines (cf. FIGS. 3 and 8), however, it is expedient to arrange as many drafting device elements as possible so that their axes stand vertically and also, as shown in particular in FIG. 8, the shafts of these rollers project upwards beyond the drafting device housings and are provided there with toothed pulleys or the like (e.g. 94, 95 in FIG. 9). It is then possible to drive all the toothed pulleys belonging to the same drafting device pairs (I, II etc.) by means of a respective toothed belt 137, 138 or 139 or the like that coaxially surrounds the centre axis 87 of the needle cylinder 2. That is shown schematically in FIG. 17, in which three groups of toothed pulleys 140, 141 and 142 arranged in a circle are provided, wherein e.g. in accordance with FIGS. 14, 15 and 16 the toothed pulleys 140 are respectively fastened to the shafts of the driving feed rollers (e.g. 112, 120, 128), the toothed pulleys 141 on the shafts of the driving apron assemblies (e.g. 115*a*, 121, 133) and the toothed pulleys 142 on the shafts of the driving withdrawal rollers (e.g. 116, 122, 131). Irrespective of the number of knitting points present, each toothed belt 137, 138 and 139 only needs one respective associated, schematically indicated drive motor 143, 144 and 145 and, if necessary, one respective associated press roller.

The horizontal drafting device elements can be driven substantially with the same drive motors. For this, in FIG. 14, for example, additional spur gears 146 are fastened to the shafts of the rollers 115*a* that mesh with further spur gears 147, which are fastened to the shafts of the bevel gears 118. A corresponding arrangement is shown in FIG. 15. In contrast, FIG. 16 shows that two further spur gears 147 and 148 can mesh with the spur gear 146, wherein the spur gear 147 serves to drive the horizontal rollers 132 by means of a bevel gear 134 corresponding to bevel gear 126 (FIG. 15) and the spur gear 148 serves to directly drive the vertical rollers 129. In the exemplary embodiment according to FIG. 13 only two toothed belts and drive motors are necessary, since the rollers 103 and 106 can be coupled here, for example, by spur gears 150, 151 to a drive shaft of the rollers 106.

Apart from this, FIGS. 13 to 16 show that in all cases structural elements either configured in the form of insertion parts 108, 109, 114, 115*b*, 116*a*, 125 and 135 or press arms can be provided in order to make all the essential function parts accessible from the work area 4, analogously to FIGS. 1, 3 and 8. However, it is expedient to use the insertion parts in particular in the location where, in accordance with FIG. 10, in the vicinity of the drafting devices particularly small distances a of e.g. few millimeters are desired between the drafting devices, since in such a case parts that can be pivoted or displaced to the side would hinder a close arrangement of the drafting devices.

Figure 18:
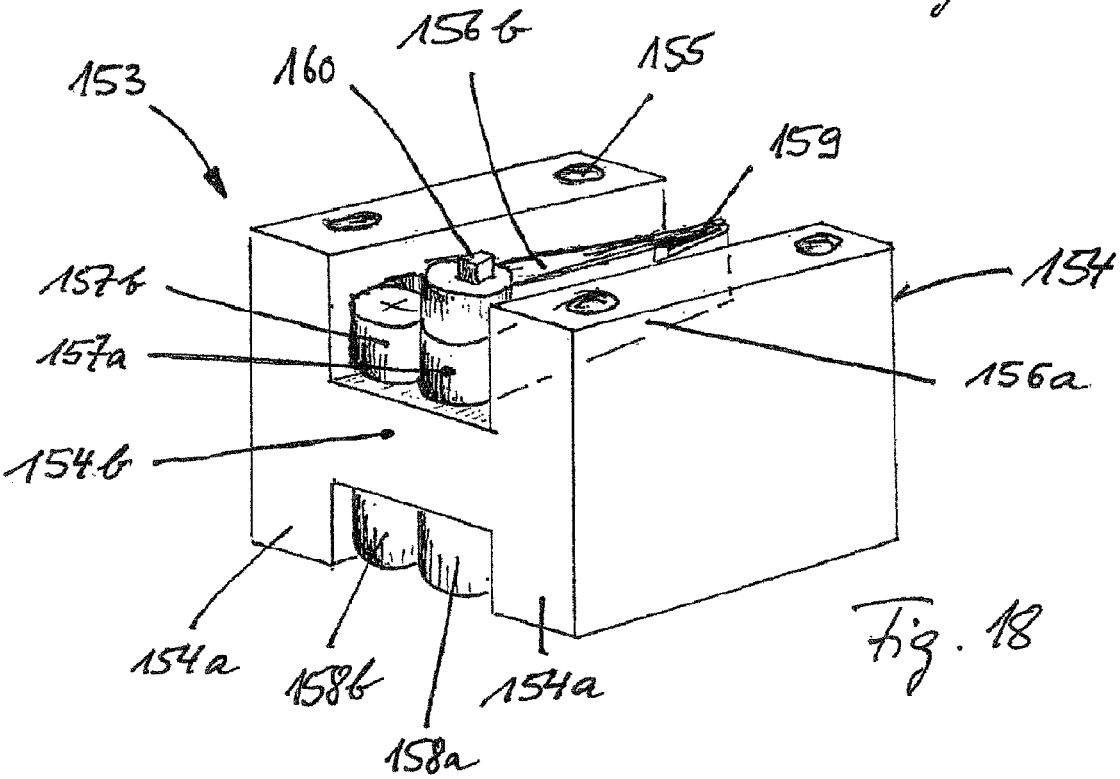
FIG. 18 is a perspective representation of a preferred embodiment of an insertion part in the form of a module.

A configuration of an insertion part 153 that is particularly preferred for the purposes of the invention is shown in FIG. 18. It includes a housing 154, which is H-shaped in front view and is provided with screw holes, threaded bores 155 or the like on the upper sides of long legs 154*a*. Two shafts extended parallel to the legs 154*a* are rotatably disposed in a short cross piece 154*b* of the H-shaped housing 154. A respective roller 157*a*, 157*b* or 158*a*, 158*b* intended to drive an apron 156*a*, 156*b*, for example, is fastened on these shafts on both sides of the cross piece 154*b*, and the aprons 156*a*, 156*b* (the second apron pair is not visible in FIG. 18) are guided as usual by these rollers and two deflection elements 159 spaced from these, as can be clearly seen in FIG. 18 for the apron pair 156*a*, 156*b*.

FIG. 18 further shows that the roller 157*a* or its shaft, for example, is configured longer than the adjacent roller 157*b* or its shaft and, for example, projects above the upper side of the legs 154*a*, 154*b*, for example, with four or six-edged coupling pin 160. This coupling pin 160 additionally passes through a cover plate 161 (FIG. 13), for example, at the upper end of the drafting device housing. Moreover, a likewise four- or six-edged coupling sleeve 163, which is intended to receive the coupling pin 160 in a manner fixed against rotation and is open towards this, is fastened on the lower end of a drive shaft 162 associated with this apron assembly, which is driven in the manner described on the basis of FIG. 17, for example. Therefore, if an insertion part 153 configured in accordance with FIG. 18, for example, is pulled downwards out of the drafting device housing in the direction of arrow u, then the parts 160 and 161, which represent the couplings 110 indicated schematically in FIGS. 13 to 15, are automatically separated from one another. Otherwise, the arrangement is such that when the insertion part 153 runs into the drafting device housing the coupling pin 160 automatically enters the coupling sleeve 163 and thus connects the apron assembly to the associated drive. After the housing 154 is laid against the cover plate 161, it is fastened with fastening screws screwed into the bore 155.

The other described insertion parts with vertically arranged function parts can be configured accordingly, wherein the aprons are omitted, depending on the respective case. In a similar manner, such insertion parts that are provided with horizontal function parts (e.g. 123 in FIG. 15) can also be provided. In this case, the bevel gears 98 described on the basis of FIGS. 9, 9*a* or the spur gears 118 or 126 shown in FIGS. 14 and 15 replace the coupling pin 160 and the coupling sleeve 163.

Finally, FIG. 18 shows that in accordance with the tandem design described above, the insertion part 153 has a respective double-apron assembly above and below the cross piece 154*b*. In this case, the shafts or drive rollers of these assemblies are respectively only disposed on one side, i.e. on the side of the cross piece 154*b*, and are thus cantilevered, so that after the insertion part 153 has been removed from the drafting device the aprons guided by these can be detached upwards or downwards and replaced. Therefore, when the tandem design is applied, it is expedient to configure the insertion parts so that they can be removed from the drafting devices completely, whereas in the case of insertion parts that only have one apron pair (e.g. the lower one in FIG. 18), it would be sufficient if the insertion could be pulled so far downwards that the aprons to be replaced are easily accessible. Apart from this, the insertion parts 153 can be provided with resilient elements or the like, which press the driven aprons 156*b* against the driving aprons 156 during operation.

The invention is not restricted to the described exemplary embodiments, which can be modified in a simple manner. This applies in particular to the expressions "vertical" and "horizontal", since positions of the different function parts are also possible with axes differing therefrom during operation. For example, the axes of the drafting devices 18 in FIG. 1 could also be arranged at angles of between 0° and 90° to the centre axis of the needle cylinder 2. The same applies to the relative arrangement of the nip lines of the rollers causing the folding (e.g. 29 and 31), which can also enclose angles other than 90°, e.g. 45° to 90°, relative to one another. Moreover, it is clear that the described pivot arms and insertion parts only represent examples, which can be deviated from in a variety of ways, and that the insertion parts in particular can be provided with means that are not further represented to press the driven rollers and aprons resiliently or pneumatically against the driving rollers and aprons during operation. In particular for function parts further removed from the centre axis of the circular knitting machine, insertion parts that can be pulled out laterally could also be provided. Moreover, it is clear that the function parts that must be maintained and possibly frequently replaced are preferably mounted on or in the pivoting arms, insertion parts etc. so that they can be easily replaced when these are in the open state. For this, it is above all recommended, as may be seen in FIGS. 3, 6 and 18, to fundamentally mount the rollers and deflection elements (e.g. 31, 32 in FIG. 6) only at one end (cantilevered) and to arrange their free ends at the bottom or the side, so that at least the aprons can be removed towards the free ends of the driving rollers after the press arms, insertion parts etc., which are configured in virtually any desired manner, are pivoted or pulled out (cf. also FIG. 18). In association with this, it is also advantageous in particular in the case of the tandem design (FIG. 18) to configure the insertion parts such that they can be removed completely from the drafting devices, so that both double-apron assemblies present can be easily replaced. In addition, it is expedient, in particular in the pre-drafting zones, for example, to arrange filler pieces, which respectively face one another and form the guide channels for the fibre materials, between consecutive nip lines, as is indicated schematically, for example, in FIGS. 6, 13 and 14. Moreover, the number of pairs of drafting device elements used for each drafting device can differ depending on the individual case, i.e. 3-, 4-, 5-roller drafting devices etc. can be provided. In addition, the mounting of the drafting devices on a stitch-forming machine is only shown by way of example in FIGS. 1, 3 and 8. In fact, it would also be possible to mount the drafting devices in a different way, in particular on a separate frame that can be run close to the machine or surrounds this, e.g. to subsequently fit an already existing machine with the described drafting devices. Moreover, it can be advantageous to configure the aprons, e.g. those of the apron assemblies 30*a*, 30*b* in FIG. 5, to be longer than usual in transport direction 26 and to provide them with an associated clamping device, which is axially displaceable in the transport direction 26 and which in the main drafting zone creates an additional clamping zone in the gap formed by the aprons, as indicated schematically with an arrow in FIG. 5. As a result of this, the usual clamp dimension can be adapted to the length of the fibres used and the uniformity of the discharging fibre materials can be improved. Finally, it is understood that the different features can be applied in combinations other than those described and represented.

The invention claimed is:

1. A machine for producing a knitted fabric by at least partially using fibre material (10, 27), containing a multiplicity of stitch-forming points (6) and drafting devices (8, 8*b*, 25, 65, 74, 102, 111, 119, 127) having drafting device elements (18, 28-30, 35, 59, 60*b*, 80-83, 103-105, 107, 112, 113, 115, 116, 120-123, 128-133, 156-159) and associated with at least selected stitch-forming points (6) for the production of threads (11) formed from the fibre material (10, 27), and substantially consisting of untwisted parallel fibres, wherein at least a plurality of selected drafting device elements (18, 28-30, 35, 59, 60*b*, 80-83, 103-105, 107, 112, 113, 115, 116, 120-123, 128-133, 156-159) are mounted on arms (19, 44, 50, 52, 89, 91, 108, 109, 114, 125, 135, 153) disposed on the drafting devices (8, 8*b*, 25, 65, 74, 102, 111, 119, 127), so that the arms can be pivoted downwards or to the side, such that said plurality of drafting device elements pivotable or able to pulled out together to the side or downwards.

2. The machine according to claim 1, wherein the drafting devices (8, 8*b*, 25, 65, 74, 102, 111, 119, 127) are arranged above the stitch-forming points (6), but within the reach of an operator (5) working on the machine.

3. The machine according to claim 1, wherein it is configured as a circular knitting machine (1) provided with a needle cylinder (2) and knitting needles (3) and the drafting devices (8, 8*b*, 25, 65, 74) are arranged above the needle cylinder (2), but within the reach of the operator.

4. The machine according to claim 3, wherein the drafting devices (8) are arranged perpendicularly or on an angle to a centre axis (87) of the circular knitting machine (1).

5. The machine according to claim 1, wherein a plurality of drafting devices (8*b*, 74) are arranged in a star shape and are distributed radially on the periphery of the needle cylinder (2) with respect to the centre axis (87).

6. The machine according to claim 1, wherein a plurality of drafting devices (8) of the same type are arranged in a bar shape and horizontally one behind the other.

7. The machine according to claim 1, wherein the drafting device elements (18, 28-30, 35, 59, 60*b*, 80-83, 103-105, 107, 112, 113, 115, 116, 120-123, 128-133, 156-159) at least partially comprise rollers.

8. The machine according to claim 1, wherein the drafting device elements at least partially comprise apron assemblies (30*a*, 30*b*; 69*a*, 69*b*; 83*a*, 83*b*) with rollers, deflection elements and aprons.

9. The machine according to claim 1, wherein the drafting devices (8*b*) include drafting device elements (18, 18*a*) with axes extending vertically or on an angle to the vertical and at least some of these drafting device elements (18*a*) are disposed on a structural element configured as a press arm (19), which can be pivoted away laterally.

10. The machine according to claim 1, wherein the drafting devices (8*b*) are arranged in a segment shape and have at least two respective drafting device sections of the same type with drafting device elements (18, 18*a*) arranged coaxially one above the other in pairs, wherein the driven drafting device elements (18*a*) are disposed on a common press arm (19).

11. The machine according to claim 1, wherein the drafting devices (8) are arranged in a bar shape and include at least two respective drafting device elements (18) having horizontally extending axes, wherein at least some of the drafting device elements (18*a*) are disposed on a structural element configured as a press arm (19), which can be pivoted away downwards.

12. The machine according to claim 1, wherein the machine includes drafting devices (25, 65, 74, 111, 119, 127) with at least two pairs (II, Ill, V) of drafting device elements (29, 31; 29, 70; 81, 84, 103-105, 107, 112, 113, 115, 116, 120-123, 128-133, 156-159), which form nip lines (37, 38) arranged at an angle of between 0° and 90° to one another.

13. The machine according to claim 12, wherein the drafting devices (25, 65, 74, 111, 119, 127) are arranged as folded drafting devices and the nip lines (37, 38) arranged at an angle form a folding zone (43, 68).

14. A machine for producing a knitted fabric by at least partially using fibre material (10, 27), containing a multiplicity of stitch-forming points (6) and drafting devices (8, 8*b*, 25, 65, 74, 102, 111, 119, 127) having function parts (18, 28-30, 35, 59, 60*b*, 80-83, 103-105, 107, 112, 113, 115, 116, 120-123, 128-133, 156-159) and associated with at least selected stitch-forming points (6) for the production of threads (11) formed from the fibre material (10, 27), wherein at least a plurality of selected function parts (18, 28-30, 35, 59, 60*b*, 80-83, 103-105, 107, 112, 113, 115, 116, 120-123, 128-133, 156-159) are mounted on structural elements (19, 44, 50, 52, 89, 91, 108, 109, 114, 125, 135, 153) disposed on the drafting devices (8, 8*b*, 25, 65, 74, 102 111, 119, 127), such that said plurality of selected function parts are configured to be pivoted or pulled out together to the side or downwards, wherein said machine includes drafting devices (25, 65, 74, 111, 119, 127) with at least two pairs (II, Ill, V) of drafting device elements (29, 31; 29, 70; 81, 84, 103-105, 107, 112, 113, 115, 116, 120-123, 128-133, 156-159), which form nip lines (37, 38) arranged at an angle of between 0° and 90° to one another, wherein the drafting devices (25, 65, 74, 111, 119, 127) are arranged as folded drafting devices and the nip lines (37, 38) arranged at an angle form a folding zone (43, 68), and wherein the folding drafting devices (25, 65, 74, 111, 119, 127) have at least four pairs (I to V) of drafting device elements (28, 29, 30, 35; 28, 29, 69, 35; 80-83, 103-105, 107, 112, 113, 115, 116, 120-123, 128-133, 156-159), wherein when viewed in a transport direction (26) for the fibre material (27) a first pair (I) and a second pair (II) form a pre-drafting zone (41, 67), the second pair (II) and third pair (III, V) form the folding zone (43, 68) and the third pair (III, V) and a fourth pair (IV) form a main drafting zone (62, 66).

15. The machine according to claim 14, wherein at least the drafting device elements (30, 69, 83, 115, 130) of the third pair (III) respectively include a roller (31, 71, 84, 115*a*, 121, 133), a deflection element (32, 72) and an apron (34, 70, 85).

16. The machine according to claim 15, wherein at least the driven drafting device elements (30, 69, 83, 115, 130) of the third pair (III) are disposed on a structural element in the form of a press arm (19, 44, 91), which can be pivoted away downwards or to the side.

17. The machine according to claim 16, wherein the driven drafting device elements (30*b*, 69*b*) of the third pair (III) are disposed on a first arm (52) and a driven drafting device element (35*b*) of the fourth pair (IV) is disposed on the same or a separate second arm (50).

18. The machine according to claim 15, wherein the drafting device elements (83*a*, 83*b*, 105, 115, 130) of the third pair (III) are disposed on a structural element configured as an insertion part (89, 108), which can be pulled downwards or to the side out of the drafting device (74, 102, 111, 119, 127).

19. The machine according to claim 18, wherein the drafting device (74) has an outwardly open recess (90) provided with guide surfaces (90*b*), in which the insertion part (89) is displaceably disposed.

20. The machine according to claim 18, wherein the fourth pair (IV) has driving and driven drafting device elements (82*a*, 82*b*) and the driven drafting device element (82*b*) is disposed on the insertion part (89).

21. The machine according to claim 14, wherein the drafting device elements (28, 29, 80, 81) of the first and second pair (I, II) form a guide path (63) for the fibre material (27) lying substantially in a first plane, whereas the drafting device elements (30, 35; 35, 69; 82, 83) of the third and fourth pair (III, IV) form a guide path (73, 86) for the fibre material (27) lying substantially in a second plane, so that the two guide paths (63; 73, 86) merge into one another along a bend (K).

22. The machine according to claim 1, wherein the drafting devices (25, 65) have function parts in the form of air ducts (60) and the air ducts (60) are provided with sections (60*b*) fastened to the arms (52) or the insertion parts (89).

23. The machine according to claim 1, wherein the drafting devices (65) have function parts in the form of filler pieces (59), which are fastened to the arms (50, 52) or to the insertion part (89).

24. The machine according to claim 1, wherein the drafting devices (102) include function parts in the form of a nozzle assembly (107), which is mounted on an insertion part (109), which can be pulled out downwards.

25. The machine according to claim 24, wherein the insertion parts (89, 108, 114, 135), at least where they have driving function parts (84, 104, 106, 112, 113, 115*a*, 116, 120, 121, 122, 123, 132), are coupled by means of couplings to the drive parts (140, 141, 142) associated with the drafting device (74, 102, 111, 119, 127).

26. The machine according to claim 25, wherein the couplings include bevel gears (98, 118, 126) for function parts (84, 112, 113, 123, 132) with horizontal axes.

27. The machine according to claim 26, wherein couplings (110) have coupling elements in the form of coupling pins (160) and coupling sleeves (163) for function parts (104, 106, 115*a*, 116, 120-122) with vertical axes.

* * * * *